US012805645B2

(12) United States Patent
Zeng et al.

(10) Patent No.: US 12,805,645 B2
(45) Date of Patent: Nov. 24, 2026

(54) INFLATABLE MATTRESS

(71) Applicant: BESTWAY INFLATABLES & MATERIAL CORP., Shanghai (CN)

(72) Inventors: Xianglin Zeng, Shanghai (CN); Xinru Chen, Shanghai (CN); Yihua You, Shanghai (CN); Qingshui Song, Shanghai (CN); Bingrong Wu, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 0 days.

(21) Appl. No.: 19/259,921

(22) Filed: Jul. 3, 2025

(65) Prior Publication Data

US 2026/0007247 A1 Jan. 8, 2026

(30) Foreign Application Priority Data

Jul. 8, 2024 (CN) ..... 202421608387.4

(51) Int. Cl.
*A47C 27/08* (2006.01)

(52) U.S. Cl.
CPC ..... *A47C 27/081* (2013.01)

(58) Field of Classification Search
CPC .... A47C 27/081; A47C 27/087; A47G 9/1027
See application file for complete search history.

(56) References Cited

U.S. PATENT DOCUMENTS

| | | | | |
|---|---|---|---|---|
| 277,979 | A * | 5/1883 | Blochman | A47C 27/081 5/644 |
| 1,382,831 | A * | 6/1921 | Hilker | A47C 27/081 428/102 |
| 10,945,533 | B1 * | 3/2021 | Shi | A47C 27/081 |
| 11,964,460 | B1 * | 4/2024 | Xia | A47C 27/087 |
| 12,226,020 | B2 * | 2/2025 | Shi | A47C 27/087 |
| 12,543,863 | B1 * | 2/2026 | Wilson | A47C 27/081 |
| 12,604,994 | B2 * | 4/2026 | Xia | A47C 27/088 |

(Continued)

FOREIGN PATENT DOCUMENTS

| | | | | |
|---|---|---|---|---|
| CN | 2424691 | Y * | 3/2001 | A47C 27/087 |
| CN | 107411428 | A | 12/2017 | |

(Continued)

OTHER PUBLICATIONS

Extended European Search Report regarding corresponding EP App. No. 24223199.1; dated Jun. 2, 2025.

*Primary Examiner* — Eric J Kurilla
(74) *Attorney, Agent, or Firm* — Dickinson Wright PLLC

(57) ABSTRACT

An inflatable mattress includes a first sheet and a second sheet among which is defined an inflatable chamber. Both the first sheet and the second sheet have a main portion including edges and chamfered edges. At least one of the main portions of the first sheet or of the second sheet includes a first chamfered edge connecting a first edge and a third edge of the main portion. At least one side element includes a first edge connected to a first edge of the main portion of the first or second sheet. Said at least one side element is provided with a first end portion having a first beveled edge connected to the first chamfered edge of the main portion of the first or second sheet.

20 Claims, 24 Drawing Sheets

(56) References Cited

U.S. PATENT DOCUMENTS

| | | | | |
|---|---|---|---|---|
| 2015/0096126 | A1* | 4/2015 | Chai | A47C 27/087<br>5/706 |
| 2021/0259434 | A1* | 8/2021 | Wang | A47C 27/10 |
| 2023/0051768 | A1* | 2/2023 | Steele | B65D 21/08 |
| 2025/0375045 | A1* | 12/2025 | Huang | A47C 27/10 |

FOREIGN PATENT DOCUMENTS

| | | | | |
|---|---|---|---|---|
| CN | 209031630 | U * | 6/2019 | A47C 27/087 |
| DE | 20018566 | U1 | 12/2000 | |
| JP | H0657254 | U * | 8/1994 | A47C 27/087 |

* cited by examiner

INFLATABLE MATTRESS

CROSS-REFERENCE TO RELATED APPLICATIONS

This application claims the benefit of Chinese Utility Model No. CN202421608387.4, filed Jul. 8, 2024, the entire contents of which are hereby incorporated by reference in their entirety.

TECHNICAL FIELD

The present disclosure relates to the field of inflatable products, and in particular to an inflatable mattress.

BACKGROUND

Inflatable products such as inflatable mattresses and inflatable sofas are popular due to their light weight, convenient packing and storage and other features. Traditional inflatable mattresses may include a top sheet, a bottom sheet, a side sheet extending circumferentially to form an enclosure shape, and tensioning members. An upper end portion of the side sheet may be connected to the top sheet, and a lower end portion of the side sheet may be connected to the bottom sheet. The tensioning members may be located inside the inflatable mattress and connect the top sheet and the bottom sheet.

During the manufacture of an inflatable mattress, the enclosure-shaped side sheet cannot be folded into a planar shape to be connected to the top sheet and the bottom sheet, but needs to be manually sleeved on a mold to maintain the substantially enclosure shape thereof; and then, the top sheet and the bottom sheet are connected to the upper end portion and the lower end portion of the side sheet respectively. This manual operation in the manufacturing process results in high costs and also a high reject ratio of the inflatable mattress.

SUMMARY

In view of the foregoing technical problems, a first aspect of the present disclosure provides an inflatable mattress. The inflatable mattress may include a first sheet and a second sheet.

In some embodiments, the first sheet has a main portion.

In some embodiments, the main portion of the first sheet comprises a first edge and a second edge arranged opposite each other.

In some embodiments, the main portion of the first sheet comprises a third edge and a fourth edge arranged opposite each other.

In some embodiments, the second sheet has a main portion.

In some embodiments, the main portion of the second sheet comprises a first edge and a second edge arranged opposite each other.

In some embodiments, the main portion of the second sheet comprises a third edge and a fourth edge arranged opposite each other.

In some embodiments, at least one of the main portions of the first sheet or of the second sheet comprises a first chamfered edge connecting the first edge and the third edge.

In some embodiments, at least one side element at least partly delimits an inflatable chamber together with the main portions of the first sheet and of the second sheet.

In some embodiments, the side element comprises a first edge connected to the first edge of the main portion of the first sheet.

In some embodiments, the side element comprises a second edge arranged opposite the first edge of the first side element and connected to the first edge of the main portion of the second sheet.

In some embodiments, the side element comprises a first end portion comprising a first beveled edge connected to the first chamfered edge of the main portion of the first sheet or of the second sheet and a second end portion.

In some embodiments, the main portion of the first sheet or of the second sheet further comprises a second chamfered edge connecting the first edge and the fourth edge of the main portion of the first sheet.

In some embodiments, the second end portion of the side element comprises a second beveled edge connected to the second chamfered edge of the main portion of the first sheet.

In some embodiments, the side element is a first side element and the inflatable mattress comprises a second side element.

In some embodiments, the second side element comprises a first edge connected to the second edge of the main portion of the first sheet.

In some embodiments, the second side element comprises a second edge arranged opposite the first edge of the second side element and connected to the second edge of the main portion of the second sheet.

In some embodiments, the second side element comprises a first end portion comprising a first beveled edge.

In some embodiments, the second side element comprises a second end portion comprising a second beveled edge.

In some embodiments, the main portion of the first sheet further comprises a third chamfered edge connecting the second edge and the third edge of the main portion of the first sheet.

In some embodiments, the main portion of the first sheet further comprises a fourth chamfered edge connecting the second edge and the fourth edge of the main portion of the first sheet.

In some embodiments, the first beveled edge of the first end portion of the second side element is connected to the third chamfered edge of main portion of the first sheet.

In some embodiments, the second beveled edge of the second end portion of the second side element is connected to the fourth chamfered edge of the main portion of the second sheet.

In some embodiments, the main portion of the second sheet further comprises a first chamfered edge connecting the first edge and the third edge of the main portion of the second sheet.

In some embodiments, the main portion of the second sheet further comprises a second chamfered edge connecting the first edge and the fourth edge of the main portion of the second sheet.

In some embodiments, the first end portion of the first side element comprises a third beveled edge connected to the first chamfered edge of the main portion of the second sheet.

In some embodiments, the second end portion of the first side element comprises a fourth beveled edge connected to the second chamfered edge of the main portion of the second sheet.

In some embodiments, the main portion of the second sheet further comprises a third chamfered edge connecting the second edge and the third edge of the main portion of the second sheet.

In some embodiments, the main portion of the second sheet further comprises a fourth chamfered edge connecting the second edge and the fourth edge of the main portion of the second sheet.

In some embodiments, the first end portion of the second side element comprises a third beveled edge connected to the third chamfered edge of the main portion of the second sheet.

In some embodiments, the second end portion of the second side element comprises a fourth beveled edge connected to the fourth chamfered edge of the main portion of the second sheet.

In some embodiments, the first side element comprises a first side sub-sheet and a second side sub-sheet.

In some embodiments, the first side sub-sheet comprises the first edge of the first side element, the first beveled edge of the first side element and a joining edge.

In some embodiments, the second side sub-sheet comprises the second edge of the first side element, the third beveled edge of the first side element and a joining edge connected to the joining edge of the first side sub-sheet.

In some embodiments, the main portion of the first sheet further comprises a second chamfered edge connecting the first edge and the fourth edge of the main portion of the second sheet.

In some embodiments, the second end portion of the first side element comprises a second beveled edge connected to the second chamfered edge of the main portion of the first sheet.

In some embodiments, the first side sub-sheet comprises the second beveled edge of the first side element.

In some embodiments, the main portion of the second sheet further comprises a second chamfered edge connecting the first edge and the fourth edge of the main portion of the second sheet.

In some embodiments, the second end portion of the first side element comprises a fourth beveled edge connected to the second chamfered edge of the main portion of the second sheet.

In some embodiments, the second side sub-sheet comprises the fourth beveled edge of the first side element.

In some embodiments, the first side sub-sheet and the main portion of the first sheet are made of the same piece of material.

In some embodiments, the second side sub-sheet and the main portion of the second sheet are made of the same piece of material.

In some embodiments, the third edge of the main portion of the first sheet is directly connected to the third edge of the main portion of the second sheet.

In some embodiments, the fourth edge of the main portion of the first sheet is directly connected to the fourth edge of the main portion of the second sheet.

In an embodiment, the third edge of the first sheet is directly connected to the third edge of the second sheet, and the fourth edge of the first sheet is directly connected to the fourth edge of the second sheet.

A second aspect of the present disclosure provides an inflatable mattress. The inflatable mattress includes: a first sheet, including: a substantially rectangular main portion including a first chamfered edge; a first side portion including: a first edge, and a first end portion including a first beveled edge connected to the first chamfered edge of the main portion of the first sheet; and a second sheet arranged opposite the first sheet, the second sheet including: a substantially rectangular main portion including a first chamfered edge; a first side portion including: a first edge, and a first end portion including a first beveled edge connected to the first chamfered edge of the main portion of the second sheet; wherein the first edge of the first side portion of the first sheet is connected to the first edge of the first side portion of the second sheet.

A third aspect of the present disclosure provides an inflatable mattress. The inflatable mattress includes: a first sheet, the first sheet being substantially rectangular and including: a first edge and a second edge arranged opposite each other, a third edge and a fourth edge arranged opposite each other, and a first chamfered edge connecting the first edge of the first sheet and the third edge of the first sheet; and a second sheet arranged opposite the first sheet, the second sheet including: a substantially rectangular main portion; a first side portion including: a first edge connected to the first edge of the first sheet, and a first end portion including a first beveled edge connected to the first chamfered edge of the first sheet.

In some embodiments, the first end portion of the first side portion includes a second beveled edge, the main portion of the second sheet includes a first chamfered edge, and the second beveled edge of the first end portion of the first side portion is connected to the first chamfered edge of the main portion of the second sheet.

The beneficial effects of the present disclosure are as follows. In the inflatable mattress of the present disclosure, the first sheet has the first chamfered edge, and the first side sheet has the first beveled edge. During the manufacture of the inflatable mattress, the first side sheet and the first sheet are stacked in a planar shape, and the first chamfered edge of the first sheet is aligned with the first beveled edge of the first side sheet. In this way, the first side sheet and the first sheet can be connected substantially in the same plane by using an automatic device. Therefore, the level of automation of manufacturing the inflatable mattress is improved, the number of personnel required to manufacture the inflatable mattress is decreased, then the manufacturing cost is reduced, and errors caused by human factors are also decreased, which is thus conducive to improving the yield of the inflatable mattress.

BRIEF DESCRIPTION OF THE DRAWINGS

Other features and advantages of the present disclosure will be understood from the following embodiments described in detail herein and with reference to the accompanying drawings, in which like reference numerals represent the same or similar components.

DETAILED DESCRIPTION

Figure 1:
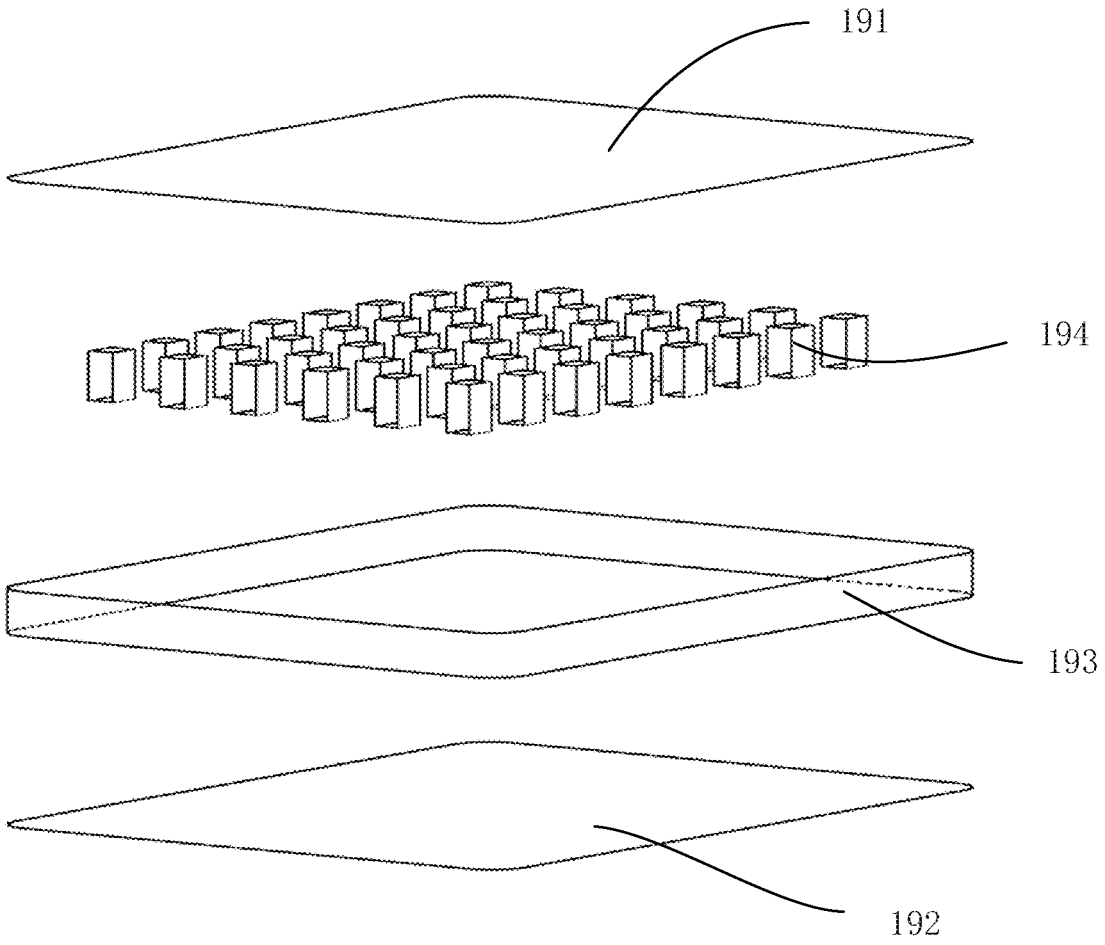
FIG. 1 PRIOR ART
FIG. 1 schematically shows a structure of an existing inflatable mattress, according to one or more embodiments shown and described herein.

Embodiments of the present disclosure are illustrated below, and those skilled in the art may readily understand advantages and effects of the present disclosure from the content disclosed in the description. Although the description of the present disclosure will be introduced in conjunction with preferred embodiments, it does not mean that features of the present disclosure are limited to the implementations described herein. On the contrary, an objective of introducing the present disclosure in conjunction with the embodiments described herein is to encompass other options or modifications that may be extended on the basis of the claims of the present disclosure. The following description contains numerous specific details in order to provide deep understanding of the present disclosure. The present disclosure may also be implemented without these details. In addition, in order to avoid confusion of the present disclosure, some specific details will be omitted in the description. It should be noted that the embodiments and the features thereof in the present disclosure can be combined with each other without conflicts.

In the description of the present disclosure, it should be understood that orientation or position relationships indicated by terms such as "center", "longitudinal", "transverse", "length", "width", "thickness", "up", "down", "front", "rear", "left", "right", "vertical", "horizontal", "top", "bottom", "inside", "outside", "clockwise", and "anti-clockwise" are based on orientation or position relationships shown in the accompanying drawings and are merely for case of description of the present disclosure and simplification of the description, rather than indicating or implying that the apparatuses or elements referred to must have a specific orientation or be constructed and operated in a specific orientation, and therefore cannot be construed as limiting the present disclosure.

In addition, terms "first", "second", etc. are merely for the purpose of description, and should not be construed as indicating or implying the relative importance or implicitly indicating the number of technical features indicated. Thus, the features defined with "first" and "second" may explicitly or implicitly include one or more features. In the description of the present disclosure, the meaning of "a plurality of" is two or more, unless specifically defined otherwise.

In the present disclosure, it should also be noted that the terms "arrange", "connected", and "connection" should be understood in a broad sense, unless otherwise explicitly specified and limited. For example, the connection may be a secured connection, a detachable connection, or an integral connection; or may be a mechanical connection or an electrical connection; or may be a direct connection, an indirect connection by means of an intermediate medium, or internal communication between two elements. For those of ordinary skill in the art, the specific meaning of the terms mentioned above in the embodiments should be understood in specific cases.

In the present disclosure, unless otherwise explicitly specified and defined, the first feature being "above" or "below" the second feature may include the first and second features being in direct contact, or may include the first and second features being not in direct contact but coming into contact through another feature between them. In addition, the first feature being "above", "over", and "on" the second feature includes the first feature being directly above and obliquely above the second feature, or simply means that the level of the first feature is higher than that of the second feature. The first feature being "below", "beneath", and "on underside of" the second feature includes the first feature being directly below and obliquely below the second feature, or simply means that the level of the first feature is less than that of the second feature.

In the description of the present disclosure, the meaning of "a plurality of" is two or more, unless specifically defined otherwise.

To make the objectives, technical solutions, and advantages of the present disclosure clearer, the technical solutions of the present disclosure will be clearly and completely described with reference to specific embodiments of the present disclosure and corresponding figures.

Referring now to the drawings, it should be appreciated that the inflatable mattress 10 may comprise a first sheet 11 and a second sheet 12 among which is defined an inflatable chamber 13.

In some embodiments, within the chamber 13 are located tensioning members 101 configured to provide a tensile force for the first sheet 11 and the second sheet 12 to limit the deformation of the inflatable mattress 10, so that the inflatable mattress 10 remains in a preset shape after being inflated.

Both the first sheet 11 and the second sheet 12 have a main portion 20, 30, 40, 50, which may have a rectangular shape, comprising edges and chamfered edges.

In particular, the main portion of the first sheet 11 comprises: a first edge 111, 316, and a second edge 112, 326 arranged opposite each other, a third edge 113, 301 and a fourth edge 114, 302 arranged opposite each other.

The main portion of the second sheet 12 comprises: a first edge 121, 416, 517 and a second edge 122, 426, 527 arranged opposite each other, a third edge 123, 401, 501 and a fourth edge 124, 402, 502 arranged opposite each other; and at least one of the main portions of the first sheet 11 or of the second sheet 12 comprises a first chamfered edge 115*a*, 203, 303, 403, 503 connecting the first edge 111, 316, 121, 416, 517 and the third edge 113, 301, 123, 401, 501.

The main portions of the first sheet 11 and the second sheet 12 may be connected by means of side elements 14, 21, 31, 41, 51, 15, 22, 32, 42, 52.

In some embodiments, the side elements 14, 21, 31, 41, 51, 15, 22, 32, 42, 52 at least partly delimits the inflatable chamber 13 together with the first sheet 11 and the second sheet 12.

At least one of the side elements 14, 21, 31, 41, 51, 15, 22, 32, 42, 52 comprises a first edge connected to a first edge 111, 316, 121, 416, 517 of the main portion 20, 30, 40, 50 of the first sheet 11 or second sheet 12.

Said at least one side element 14, 21, 31, 41, 51, 15, 22, 32, 42, 52 may be provided with a first end portion 143, 212, 312, 412, 513 comprising a first beveled edge 145, 214, 314, 514 connected to the first chamfered edge 115*a*, 203, 303, 403, 503 of the main portion 20, 30, 40, 50 of the first sheet 11 or second sheet 12.

Said at least one side element 14, 21, 31, 41, 51, 15, 22, 32, 42, 52 can be defined by a side sheet 14, 15 separated from the first sheet 11 and the second sheet 12 or by a side portion 21, 31, 41, 51, 22, 32, 42, 52 integrally formed with at least one of the first sheet 11 and the second sheet 12.

Figure 2A:
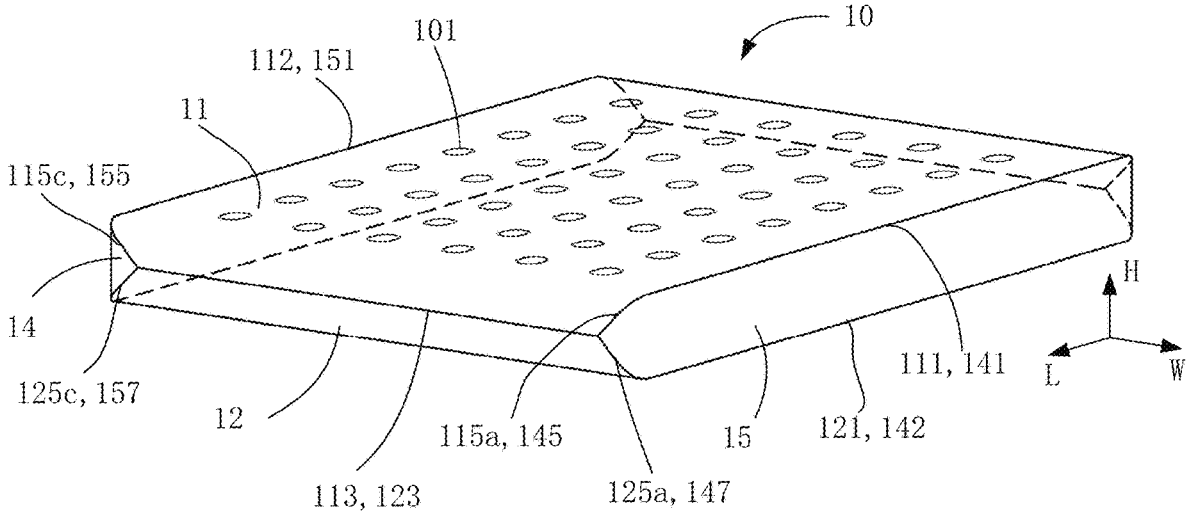
FIG. 2*a* schematically shows a first embodiment of an inflatable mattress according to one or more embodiments shown and described here.
Figure 2B:
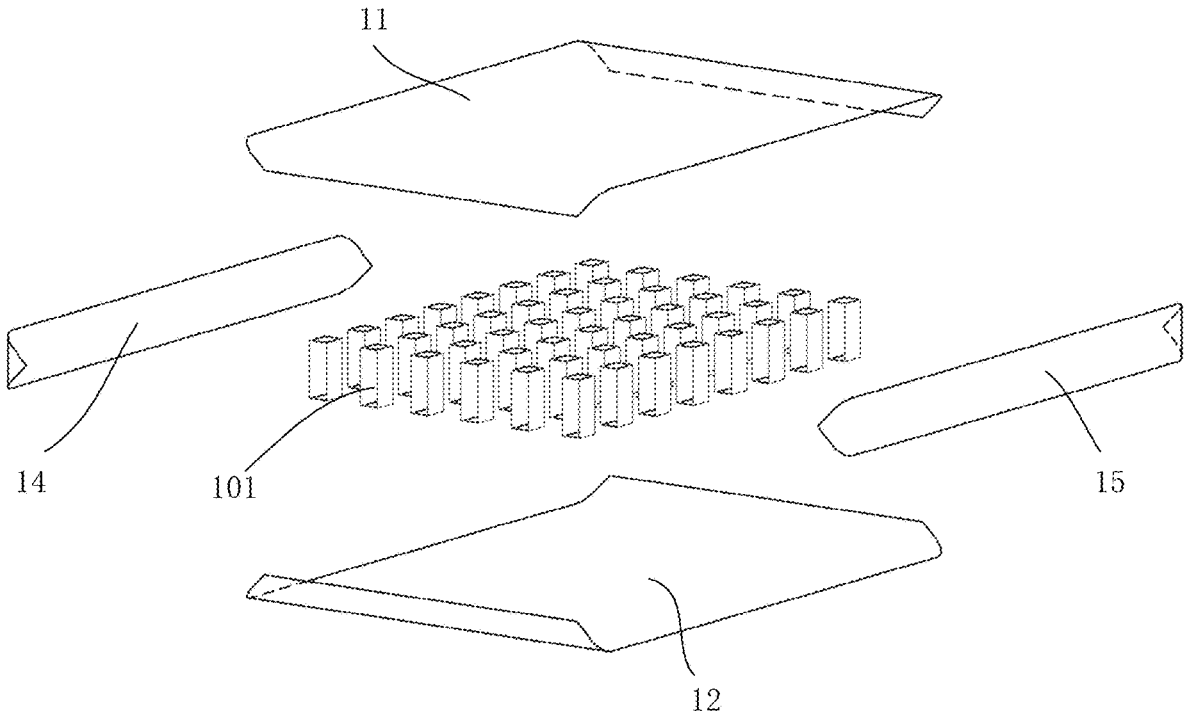
FIG. 2*b* is an exploded view of the inflatable mattress of FIG. 2*a*, according to one or more embodiments shown and described herein.

Referring now to FIGS. 2*a* and 2*b*, the inflatable mattress 10 of the first embodiment is substantially rectangular, and includes the first sheet 11, the second sheet 12, a first side sheet 14 defining the first side element, a second side sheet 15 defining the second side element and tensioning members 101.

The first sheet 11 is fully defined by its main portion 11'. In other words, the edges of the first sheet 11 correspond to the edges of the main portion 11'. The second sheet 12 is opposite and spaced apart from the first sheet 11 in a height direction H of the inflatable mattress 10. The first side sheet 14 and the second side sheet 15 are spaced apart from each other in a width direction W of the inflatable mattress 10.

The first side sheet 14 and the second side sheet 15 are connected between the first sheet 11 and the second sheet 12. The first sheet 11, the second sheet 12, the first side sheet 14 and the second side sheet 15 define an inflatable chamber 13 for inflation. It should be understood that the inflatable mattress 10 may also be configured in other shapes. For the sake of simplicity, in the present disclosure, the technical solution of the present disclosure will be described by taking the rectangular inflatable mattress 10 as an example. The first sheet 11 may be a top sheet of the inflatable mattress, which is in contact with a user lying on the inflatable mattress. The second sheet may be a bottom sheet of the inflatable mattress, which is in contact with the ground.

After the pressure of a gas (e.g., air) in the inflatable chamber 13 reaches a desired value, the inflatable mattress 10 is in an inflated state and remains in a preset shape; and after the gas in the inflatable chamber 13 is discharged, the inflatable mattress 10 is in a deflated state, and the volume of the inflatable mattress 10 is greatly reduced relative to the volume thereof in the inflated state, thereby facilitating the storage of the inflatable mattress 10.

Figure 3A:
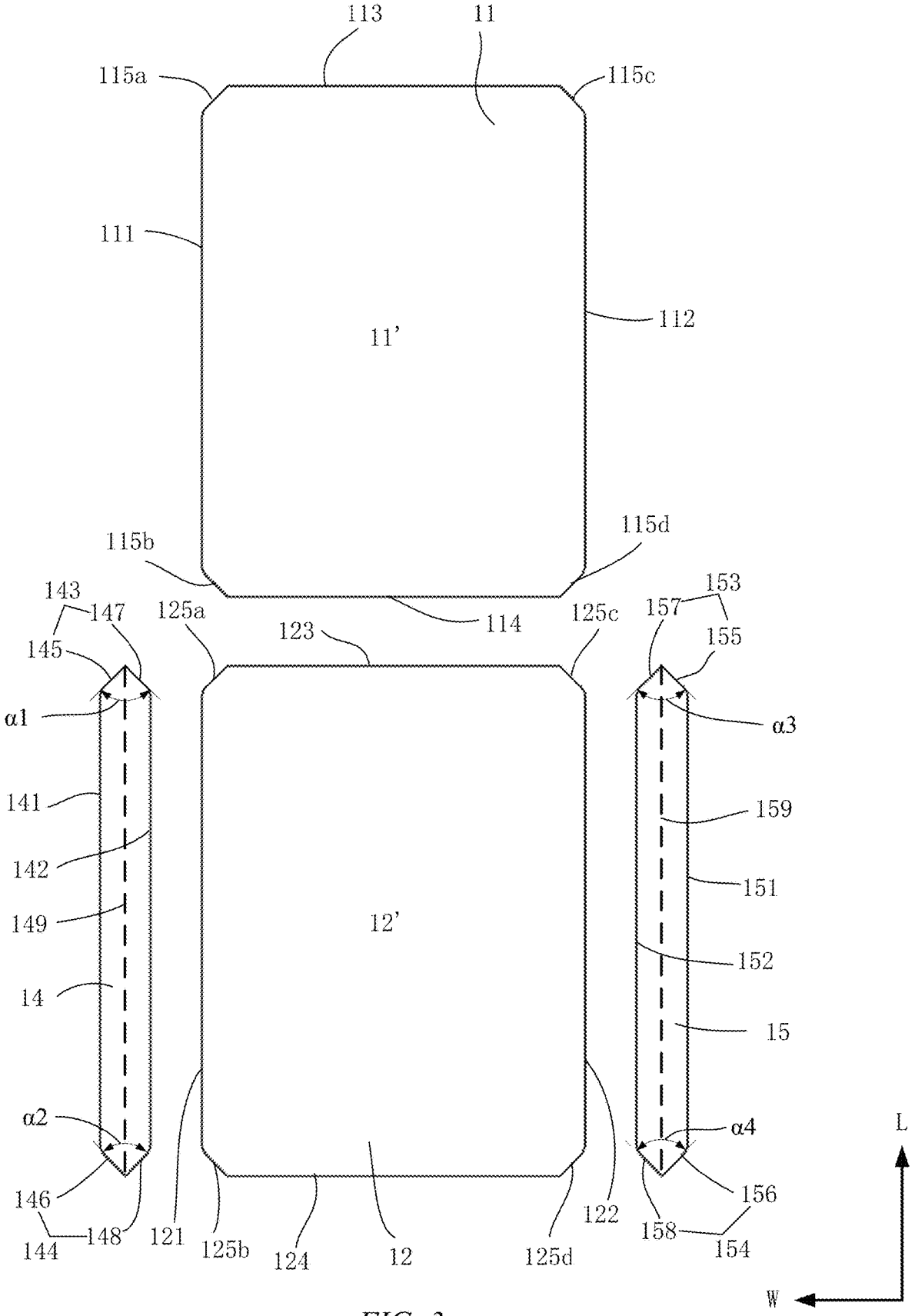
FIG. 3*a* is an expanded view of the inflatable mattress shown in FIG. 2*a*, according to one or more embodiments shown and described herein.

As shown in FIG. 3*a*, the first sheet 11 is substantially rectangular, and includes a first edge 111, a second edge 112, a third edge 113 and a fourth edge 114. The first edge 111 of the first sheet 11 and the second edge 112 of the first sheet 11 are arranged opposite each other. The third edge 113 of the first sheet 11 and the fourth edge 114 of the first sheet 11 are arranged opposite each other. For example, in the inflatable mattress 10, the first edge 111 of the first sheet 11 and the second edge 112 of the first sheet 11 extend in a length direction L of the inflatable mattress 10 (i.e., the first edge 111 of the first sheet 11 and the second edge 112 of the first sheet 11 are formed as two length edges of the first sheet 11). In some embodiments, the length direction L is transversal, or orthogonal, to the width direction W. The third edge 113 of the first sheet 11 and the fourth edge 114 of the first sheet 11 substantially extend in the width direction W of the inflatable mattress 10 (i.e., the third edge 113 of the first sheet 11 and the fourth edge 114 of the first sheet 11 are formed as two width edges of the first sheet 11).

Further, as shown in FIG. 3*a*, the first sheet 11 further includes a first chamfered edge 115*a*. In some embodiments, the first sheet 11 includes a second chamfered edge 115*b* and may also a third chamfered edge 115*c*, and a fourth chamfered edge 115*d*. The first chamfered edge 115*a* of the first sheet 11 is connected between the first edge 111 of the first sheet 11 and the third edge 113 of the first sheet 11. The second chamfered edge 115*b* of the first sheet 11 is connected between the first edge 111 of the first sheet 11 and the fourth edge 114 of the first sheet 11. The third chamfered edge 115*c* of the first sheet 11 is connected between the second edge 112 of the first sheet 11 and the third edge 113 of the first sheet 11. The fourth chamfered edge 115*d* of the first sheet 11 is connected between the second edge 112 of the first sheet 11 and the fourth edge 114 of the first sheet 11.

In an embodiment, the first chamfered edge 115*a* of the first sheet 11, the second chamfered edge 115*b* of the first sheet 11, the third chamfered edge 115*c* of the first sheet 11, and the fourth chamfered edge 115*d* of the first sheet 11 are all equal in length.

Further, as shown in FIG. 3*a*, the shape of the second sheet 12 is the same as that of the first sheet 11. For example, the second sheet 12 includes a first edge 121, a second edge 122, a third edge 123, and a fourth edge 124. The second sheet 12 further includes a first chamfered edge 125*a*. In some embodiments, the second sheet 12 includes a second chamfered edge 125*b*, a third chamfered edge 125*c*, and a fourth chamfered edge 125*d*.

The first edge 121 of the second sheet 12 is arranged opposite the second edge 122 of the second sheet 12. The third edge 123 of the second sheet 12 is arranged opposite the fourth edge 124 of the second sheet 12. The first chamfered edge 125*a* of the second sheet 12 is connected between the first edge 121 of the second sheet 12 and the third edge 123 of the second sheet 12. The second chamfered edge 125*b* of the second sheet 12 is connected between the first edge 121 of the second sheet 12 and the fourth edge 124 of the second sheet 12. The third chamfered edge 125*c* of the second sheet 12 is connected between the second edge 122 of the second sheet 12 and the third edge 123 of the second sheet 12. The fourth chamfered edge 125*d* of the second sheet 12 is connected between the second edge 122 of the second sheet 12 and the fourth edge 124 of the second sheet 12.

In an embodiment, the first chamfered edge 125*a* of the second sheet 12 is equal in length to the first chamfered edge 115*a* of the first sheet 11. The second chamfered edge 125*b* of the second sheet 12 is equal in length to the second chamfered edge 115*b* of the first sheet 11. The third chamfered edge 125*c* of the second sheet 12 is equal in length to the third chamfered edge 115*c* of the first sheet 11. The fourth chamfered edge 125*d* of the second sheet 12 is equal in length to the fourth chamfered edge 115*d* of the first sheet 11. In this way, there is no need to distinguish the first sheet 11 from the second sheet 12 in the manufacturing process of the inflatable mattress 10, which is conducive to simplifying the manufacture of the inflatable mattress 10.

In the inflatable mattress 10, the first side sheet 14 is arranged in the length direction L of the inflatable mattress 10. Further, as shown in FIG. 3*a*, the first side sheet 14 has a first edge 141 and a second edge 142. The first edge 141 of the first side sheet 14 is arranged opposite the second edge 142 of the first side sheet 14. The first side sheet 14 further has a first end portion 143 and a second end portion 144 opposite the first pair of end portions 143.

The first end portion 143 of the first side sheet 14 has a first beveled edge 145 and a third beveled edge 147. One end of the first beveled edge 145 of the first side sheet 14 is connected to the first edge 141 of the first side sheet 14. The third beveled edge 147 of the first side sheet 14 is connected to the second edge 142 of the first side sheet 14. The first beveled edge 145 of the first side sheet 14 is also equal in length to and connected to the third beveled edge 147 of the first side sheet 14. The first beveled edge 145 of the first side sheet 14 is equal to the first chamfered edge 115*a* of the first sheet 11 in length. The third beveled edge 147 of the first side sheet 14 is equal to the first chamfered edge 125*a* of the second sheet 11 in length. Further, the first beveled edge 145 of the first side sheet 14, the first chamfered edge 115*a* of the first sheet 11, the third beveled edge 147 of the first side sheet 14, and the first chamfered edge 125*a* are equal in length.

In some embodiments, a first angle $\alpha 1$ is formed between the first beveled edge 145 of the first side sheet 14 and the third beveled edge 147 of the first side sheet 14. In other embodiments, the first angle $\alpha 1$ of the first side sheet 14 may be less than or equal to 160°. Further, the first angle $\alpha 1$ of the first side sheet 14 is a right angle. The first end portion 143 of the first side sheet 14 is formed in a substantially sharp-cornered shape.

The second end portion 144 of the first side sheet 14 has a second beveled edge 146 and a fourth beveled edge 148. The second beveled edge 146 of the first side sheet 14 is connected to the first edge 141 of the first side sheet 14. The fourth beveled edge 148 of the first side sheet 14 is connected to the second edge 142 of the first side sheet 14. The second beveled edge 146 of the first side sheet 14 is connected to the fourth beveled edge 148 of the first side sheet 14. The second beveled edge 146 of the first side sheet 14 is equal to the second chamfered edge 115*b* of the first sheet 11 in length. The fourth beveled edge 148 of the first side sheet 14 is equal to the second chamfered edge 125*b* of the second sheet 12 in length. Still further, the second beveled edge 146 of the first side sheet 14, the second chamfered edge 115*b* of the first sheet 11, the fourth beveled edge 148 of the first side sheet 14, and the second chamfered edge 125*b* of the second sheet 12 are equal in length.

In some embodiments, a second angle $\alpha 2$ is formed between the second beveled edge 146 of the first side sheet 14 and the fourth beveled edge 148 of the first side sheet 14. The second end portion 144 of the first side sheet 14 is also formed in a substantially sharp-cornered shape. In some embodiments, the second angle $\alpha 2$ of the first side sheet 14 may be less than or equal to 160°. Further, the second angle $\alpha 2$ of the first side sheet 14 is a right angle.

The first side sheet 14 further has a folding axis 149 extending in the length direction L of the inflatable mattress 10. The first edge 141 of the first side sheet 14, the first beveled edge 145 of the first side sheet 14, and the second beveled edge 146 of the first side sheet 14 are located at one side of the folding axis 149 of the first side sheet 14; and the second edge 142 of the first side sheet 14, the third beveled edge 147 of the first side sheet 14 and the fourth beveled edge 148 of the first side sheet 14 are located at the other side of the folding axis 149 of the first side sheet 14. The parts of the first side sheet 14 at the two sides of the folding axis 149 are symmetrical with respect to the folding axis 149. In other words, the folding axis 149 may be an axis of symmetry of the first side sheet 14 along the length direction L. When the first side sheet 14 is folded in half along the folding axis 149 of the first side sheet 14, the first edge 141 of the first side sheet 14 overlaps the second edge 142 of the first side sheet 14, the first beveled edge 145 of the first side sheet 14 overlaps the third beveled edge 147 of the first side sheet 14, and the second beveled edge 146 of the first side sheet 14 overlaps the fourth beveled edge 148 of the first side sheet 14.

In the inflatable mattress 10, the second side sheet 15 is arranged in the length direction L of the inflatable mattress 10. The second side sheet 15 has the same shape and size as the first side sheet 14. In this way, there is no need to distinguish the first side sheet 14 from the second side sheet 15 in the manufacturing process of the inflatable mattress 10, which is also conducive to simplifying the manufacture of the inflatable mattress 10. This embodiment exemplarily illustrates that the first side sheet 14 and the second side sheet 15 are arranged in the length direction L of the inflatable mattress 10, and it should be understood that the first side sheet 14 and the second side sheet 15 may also be arranged in the width direction W of the inflatable mattress 10.

Specifically, the first edge 151 of the second side sheet 15 is arranged opposite the second edge 152 of the second side sheet 15. The second side sheet 15 has a first end portion 153 and a second end portion 154 opposite the first end 153.

The first end portion 153 of the second side sheet 15 has a first beveled edge 155 and a third beveled edge 157. The first beveled edge 155 of the second side sheet 15 is connected to the first edge 151 of the second side sheet 15. The third beveled edge 157 of the second side sheet 15 is connected to the second edge 152 of the second side sheet 15. The first beveled edge 155 of the second side sheet 15 is further connected to the third beveled edge 157 of the second side sheet 15. The first beveled edge 155 of the second side sheet 15 is equal to the third chamfered edge 115*c* of the first sheet 11 in length. The third beveled edge 157 of the second side sheet 15 is equal to the third chamfered edge 125*c* of the second sheet 12 in length. Further, the first beveled edge 155 of the second side sheet 15, the third chamfered edge 115*c* of the first sheet 11, the third beveled edge 157 of the second side sheet 15, and the third chamfered edge 125*c* of the second sheet 12 are equal in length.

In some embodiments, a first angle $\alpha 3$ is further formed between the first beveled edge 155 of the second side sheet 15 and the third beveled edge 157 of the second side sheet 15. The first end portion 153 of the second side sheet 15 is formed in a substantially sharp-cornered shape. The first angle α3 of the second side sheet 15 may be less than or equal to 160°. Further, the first angle α3 of the second side sheet 15 may be a right angle.

The second end portion 154 of the second side sheet 15 has a second beveled edge 156 and a fourth beveled edge 158. The second beveled edge 156 of the second side sheet 15 is connected to the first edge 151 of the second side sheet 15. The fourth beveled edge 158 of the second side sheet 15 is connected to the second edge 152 of the second side sheet 15. The second beveled edge 156 of the second side sheet 15 is also equal in length to and connected to the fourth beveled edge 158 of the second side sheet 15. The second beveled edge 156 of the second side sheet 15 is equal to the fourth chamfered edge 115*d* of the first sheet in length. The fourth beveled edge 158 of the second side sheet 15 is equal to the fourth chamfered edge 125*d* of the second sheet 12 in length. Further, the second beveled edge 156 of the second side sheet 15 and the fourth chamfered edge 115*d* of the first sheet 11 are equal in length, and the fourth beveled edge 158 of the second side sheet 15 and the fourth chamfered edge 125*d* of the second sheet 12 are equal in length.

In some embodiments, a second angle α4 is formed between the second beveled edge 156 of the second side sheet 15 and the fourth beveled edge 158 of the second side sheet 15. The second end portion 154 of the second side sheet 15 is formed in a substantially sharp-cornered shape. The second angle α4 of the second side sheet 15 may be less than or equal to 160°. Further, the second angle α4 of the second side sheet 15 may be a right angle.

The second side sheet 15 further has a folding axis 159 extending in the length direction L of the inflatable mattress 10. The first edge 151 of the second side sheet 15, the first beveled edge 155 of the second side sheet 15, and the second beveled edge 156 of the second side sheet 15 are located at one side of the folding axis 159 of the second side sheet 15; and the second edge 152 of the second side sheet 15, the third beveled edge 157 of the second side sheet 15 and the fourth beveled edge 158 of the second side sheet 15 are located at the other side of the folding axis 159 of the second side sheet 15. The parts of the second side sheet 15 at the two sides of the folding axis 159 are symmetrical with respect to the folding axis 159. In other words, the folding axis 159 may be an axis of symmetry of the second side sheet 15 along the length direction L. When the second side sheet 15 is folded in half along the folding axis 159, the first edge 151 of the second side sheet 15 is aligned with the second edge 152 of the second side sheet 15, the first beveled edge 155 of the second side sheet 15 is aligned with the third beveled edge 157 of the second side sheet 15, and the second beveled edge 156 of the second side sheet 15 is aligned with the fourth beveled edge 158 of the second side sheet 15.

Figure 3B:
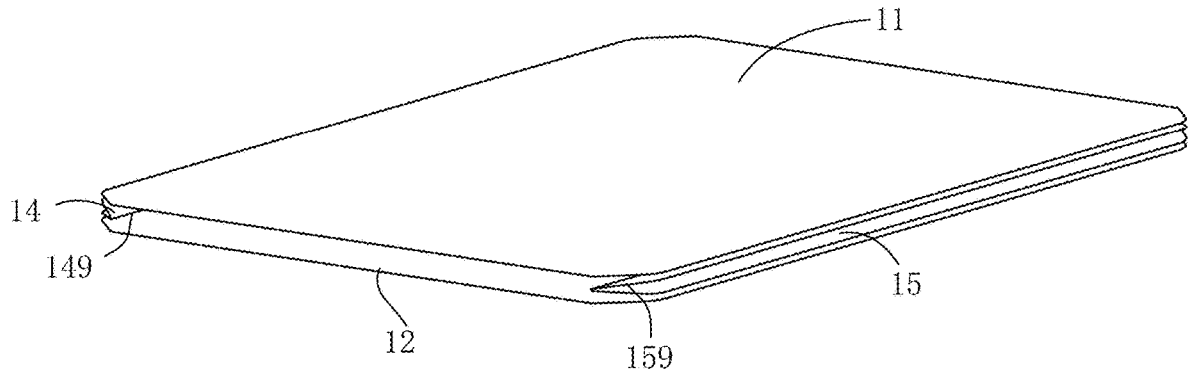
FIG. 3*b* schematically shows a manufacturing process of the inflatable mattress shown in FIG. 2*a*, according to one or more embodiments shown and described herein.

During the manufacture of the inflatable mattress 10, as shown in FIG. 3*b*, the first sheet 11 and the second sheet 12 are stacked, the first side sheet 14 and the second side sheet 15 are folded into a substantially planar shape and arranged between the first sheet 11 and the second sheet 12.

The first side sheet 14 is folded into a substantially planar shape along the folding axis 149 of the first side sheet 14. The first edge 141 of the first side sheet 14 overlaps the second edge 142 of the first side sheet 14. The first beveled edge 145 of the first side sheet 14 overlaps the third beveled edge 147 of the first side sheet 14. The second beveled edge 146 of the first side sheet 14 overlaps the fourth beveled edge 148 of the first side sheet 14. In addition, the first edge 141 of the first side sheet 14 overlaps the first edge 111 of the first sheet 11. The second edge 142 of the first side sheet 14 overlaps the first edge 121 of the second sheet 12. The first beveled edge 145 of the first side sheet 14 overlaps the first chamfered edge 115*a* of the first sheet 11. The second beveled edge 146 of the first side sheet 14 overlaps the second chamfered edge 115*b* of the first sheet 11. The third beveled edge 147 of the first side sheet 14 overlaps the first chamfered edge 125*a* of the second sheet 12. The fourth beveled edge 148 of the first side sheet 14 overlaps the second chamfered edge 125*b* of the second sheet 12.

The second side sheet 15 is folded into a substantially planar shape along the folding axis 159 of the second side sheet 15. The first edge 151 of the second side sheet 15 overlaps the second edge 152 of the second side sheet 15. The first beveled edge 155 of the second side sheet 15 overlaps the third beveled edge 157 of the second side sheet 15. The second beveled edge 156 of the second side sheet 15 overlaps the fourth beveled edge 158 of the second side sheet 15. In addition, the first edge 151 of the second side sheet 15 overlaps the second edge 112 of the first sheet 11. The second edge 152 of the second side sheet 15 overlaps the second edge 122 of the second sheet 12. The first beveled edge 155 of the second side sheet 15 overlaps the third chamfered edge 115*c* of the first sheet 11. The second beveled edge 156 of the second side sheet 15 overlaps the fourth chamfered edge 115*d* of the first sheet 11. The third beveled edge 157 of the second side sheet 15 overlaps the third chamfered edge 125*c* of the second sheet 12. The fourth beveled edge 158 of the second side sheet 15 overlaps the fourth chamfered edge 125*d* of the second sheet 12.

In this way, the first side sheet 14, the second side sheet 15, the first sheet 11 and the second sheet 12 are all in a substantially planar state and are stacked, so that a welding apparatus performs a welding operation on these sheets substantially in a plane. Thus, with regard to a manufacturing process for a mattress structure of this embodiment, a necessary step of manually fixing side sheets to a welding mold in the prior art is omitted, which provides a basis for improving the level of automation of manufacturing the mattress. After the welding operation is completed, the third edge 123 of the second sheet 12 is connected to the third edge 113 of the first sheet 11, and the fourth edge 124 of the second sheet 12 is connected to the fourth edge 114 of the first sheet 11. Moreover, the first edge 141 of the first side sheet 14 is connected to the first edge 111 of the first sheet 11. The second edge 142 of the first side sheet 14 is connected to the first edge 121 of the second sheet 12. The first beveled edge 145 of the first side sheet 14 is connected to the first chamfered edge 115*a* of the first sheet 11. The second beveled edge 146 of the first side sheet 14 is connected to the second chamfered edge 115*b* of the first sheet 11. The third beveled edge 147 of the first side sheet 14 is connected to the first chamfered edge 125*a* of the second sheet 12. The fourth beveled edge 148 of the first side sheet 14 is connected to the second chamfered edge 125*b* of the second sheet 12. The first edge 151 of the second side sheet 15 is connected to the second edge 112 of the first sheet 11. The second edge 152 of the second side sheet 15 is connected to the second edge 122 of the second sheet 12. The first beveled edge 155 of the second side sheet 15 is connected to the third chamfered edge 115*c* of the first sheet 11. The second beveled edge 156 of the second side sheet 15 is connected to the fourth chamfered edge 115*d* of the first sheet 11. The third beveled edge 157 of the second side sheet 15 is connected to the third chamfered edge 125*c* of the second sheet 12. The fourth beveled edge 158 of the second side sheet 15 is connected to the fourth chamfered edge 125*d* of the second sheet 12.

Compared with a mattress structure in the prior art, the necessary step of manually fixing the side sheets to the welding mold is omitted from the manufacturing process for the mattress structure of this embodiment, which provides a basis for improving the level of automation of manufacturing the inflatable mattress 10, and in turn decreases the number of personnel required to manufacture the inflatable mattress 10, such that the manufacturing cost of the inflatable mattress 10 is also reduced, and errors caused by human factors are decreased, thereby reducing the reject ratio of the inflatable mattress.

In an embodiment, the first sheet 11, the second sheet 12, the first side sheet 14 and the second side sheet 15 are all made of a polymer material or a multi-layer composite material including a polymer material layer. For example, the polymer material may include, but is not limited to, one or more of polyvinyl chloride (PVC), polyurethane (PU), thermoplastic urethanes (TPU), polyethylene terephthalate (PET), ethylene-vinyl acetate (EVA) copolymer and nylon. In this way, the first sheet 11, the second sheet 12, the first side sheet 14 and the second side sheet 15 can be welded together. This welding operation is simple and convenient and makes gas leakage less liable to occur at weld seams. Of course, according to the actual conditions, the first sheet 11, the second sheet 12, the first side sheet 14 and the second side sheet 15 may also be made of other materials and may also be connected by means of other connection methods, which are not limited herein.

A plurality of tensioning members 101 (as shown in FIGS. 2*a* and 2*b*) are arranged in the inflatable chamber 13 of the inflatable mattress 10. The tensioning members 101 are connected to the first sheet 11 and the second sheet 12 by means of high-frequency welding, hot melting, adhesive bonding or other connection methods. The tensioning members 101, after being tensioned, provide a tensile force for the first sheet 11 and the second sheet 12 to limit the deformation of the inflatable mattress 10, so that the inflatable mattress 10 remains in a preset shape after being inflated.

Figure 15:
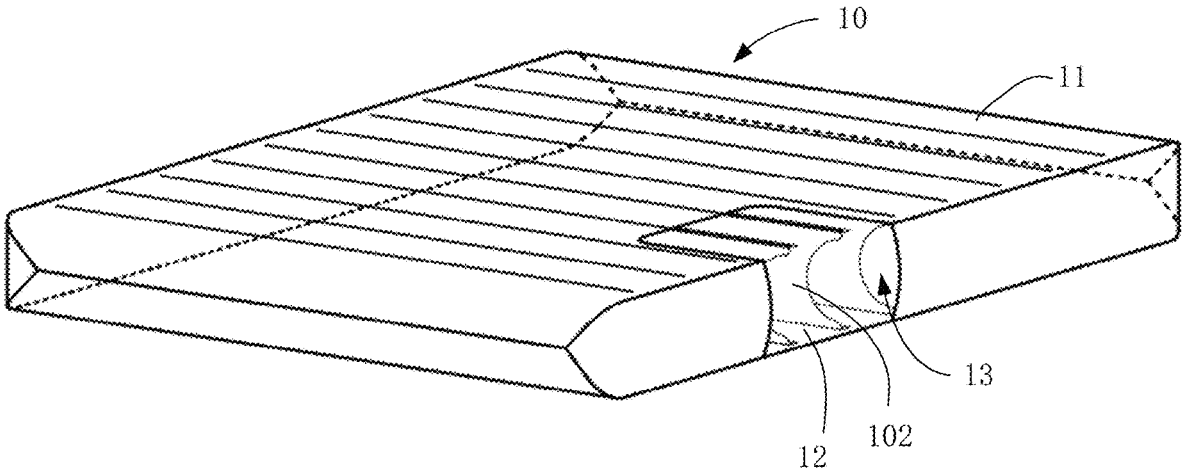
FIGS. 15 to 17 schematically show tensioning members for the inflatable mattress, according to one or more embodiments shown and described herein.
Figure 16:
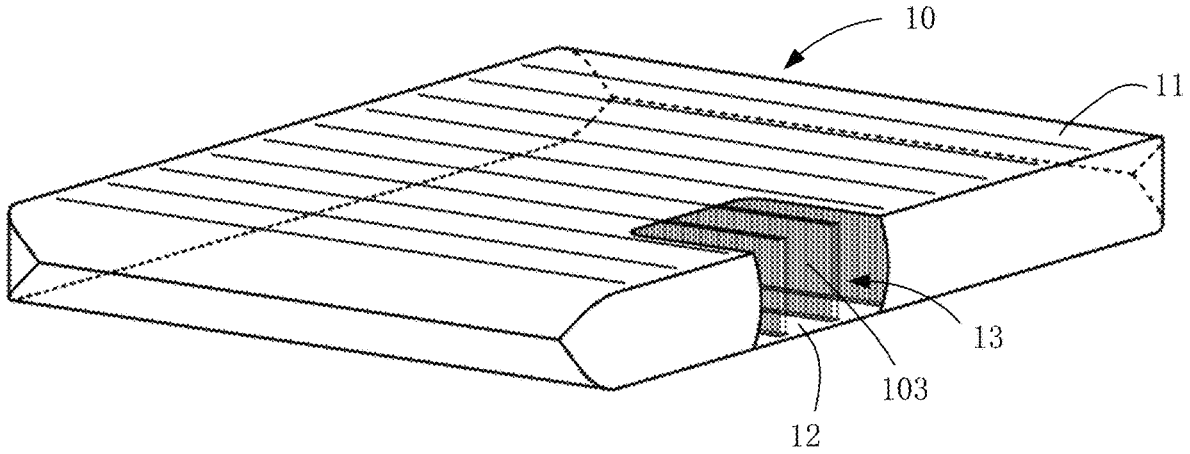
Figure 17:
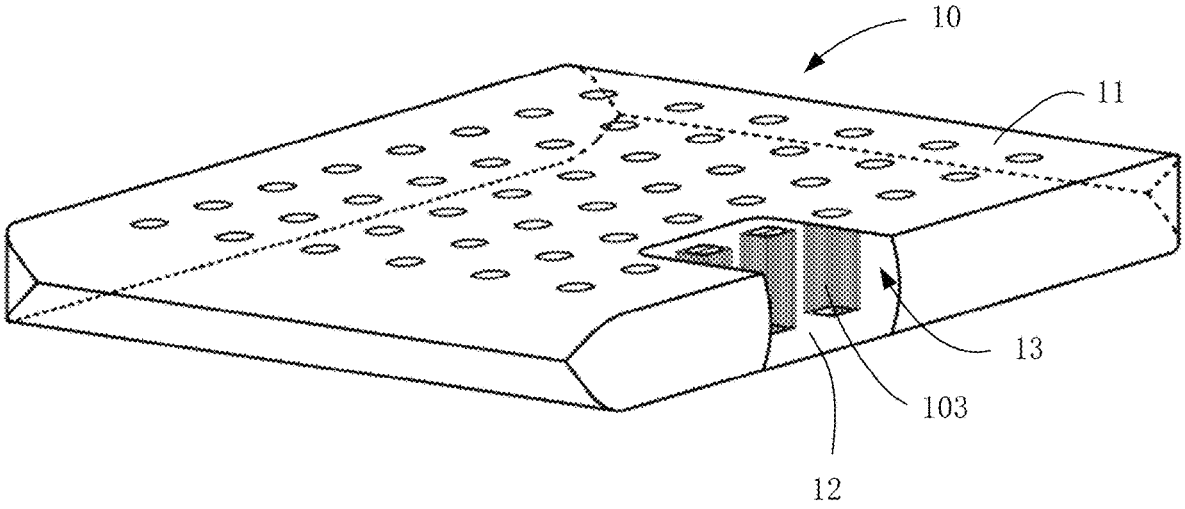

In some embodiments, the plurality of tensioning members 101 have different structures in different embodiments. For example, each tensioning member 101 is a sheet-like tensioning member 102 (as shown in FIG. 15) or a string-like tensioning member 103 (as shown in FIGS. 16 and 17).

The sheet-like tensioning member 102 may have a single-layer structure or a composite layer structure according to actual requirements.

When the sheet-like tensioning member 102 is a single-layer sheet material, it may be made of a polymer material. The polymer material may include, but is not limited to, one or more of polyvinyl chloride (PVC), polyurethane (PU), thermoplastic urethanes (TPU), polyethylene terephthalate (PET), ethylene-vinyl acetate (EVA) copolymer and nylon. It can be understood that a main portion part of the single-layer sheet-like tensioning member 102 may be made of materials other than the polymer material in some other embodiments, such as a fabric material. The fabric material may be finely woven or forms a mesh-like structure. The fabric material may be, but is not limited to, a natural fiber fabric (e.g., but not limited to, a cotton fabric, a linen fabric, a wool fabric and a silk fabric) or a synthetic fiber fabric (e.g., but not limited to, a polyester fiber fabric, a polyethylene fiber fabric, and a polypropylene fiber fabric).

When the sheet-like tensioning member 102 is made of a composite sheet material, it is composed of two or more layers of sheet materials bonded together by gluing, welding or other means, and each layer of the multi-layer sheet material may be made of the polymer material described above or the other materials described above.

The string-like tensioning member 103 includes one or more string bodies, which span a distance between the first sheet 11 and the second sheet 12 of the inflatable mattress 10 and are, in some embodiments, parallel or substantially parallel in space. For example, these string bodies are spaced from each other in such a way that the distances between these string bodies are equal or vary according to a certain regularity. The material of the one or more string bodies in the string-like tensioning member 103 may be, but is not limited to, a natural fiber (e.g., but not limited to, a cotton fiber, a linen fiber, a wool fiber, and a silk fiber) or a synthetic fiber (e.g., but not limited to, a polyester fiber, a polyethylene fiber, and a polypropylene fiber). The string-like tensioning members 103 are typically indirectly connected to the first sheet 11 and the second sheet 12 by means of connecting members. The connecting members may be made of, but not limited to, a polymer material that facilitates welding of the first sheet 11 and the second sheet 12.

Figure 4:
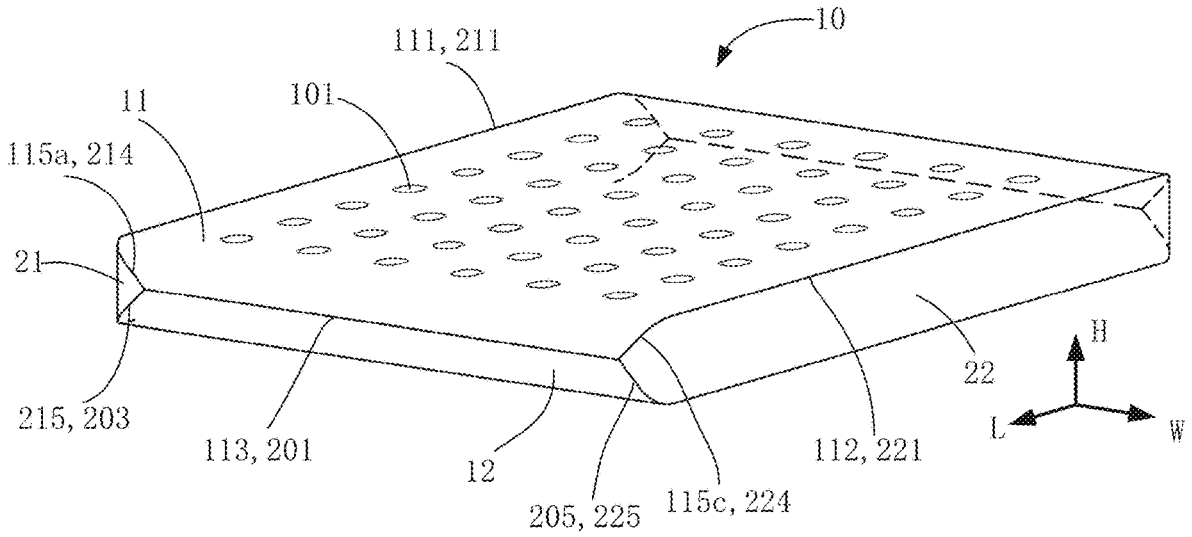
FIG. 4 schematically shows a second embodiment of an inflatable mattress, according to one or more embodiments shown and described herein.
Figure 5:
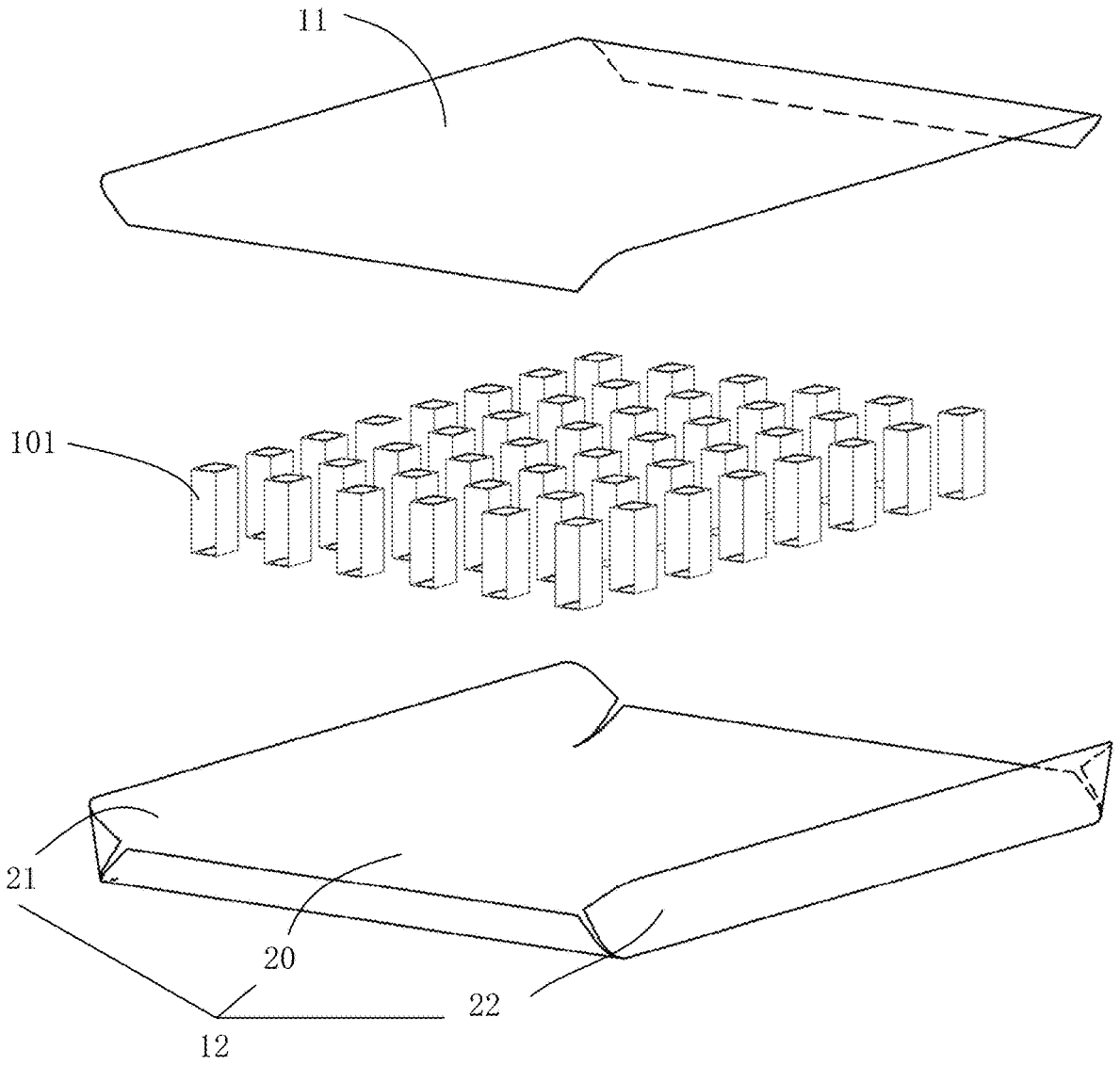
FIG. 5 is an exploded view of the inflatable mattress of FIG. 4, according to one or more embodiments shown and described herein.
Figure 6A:
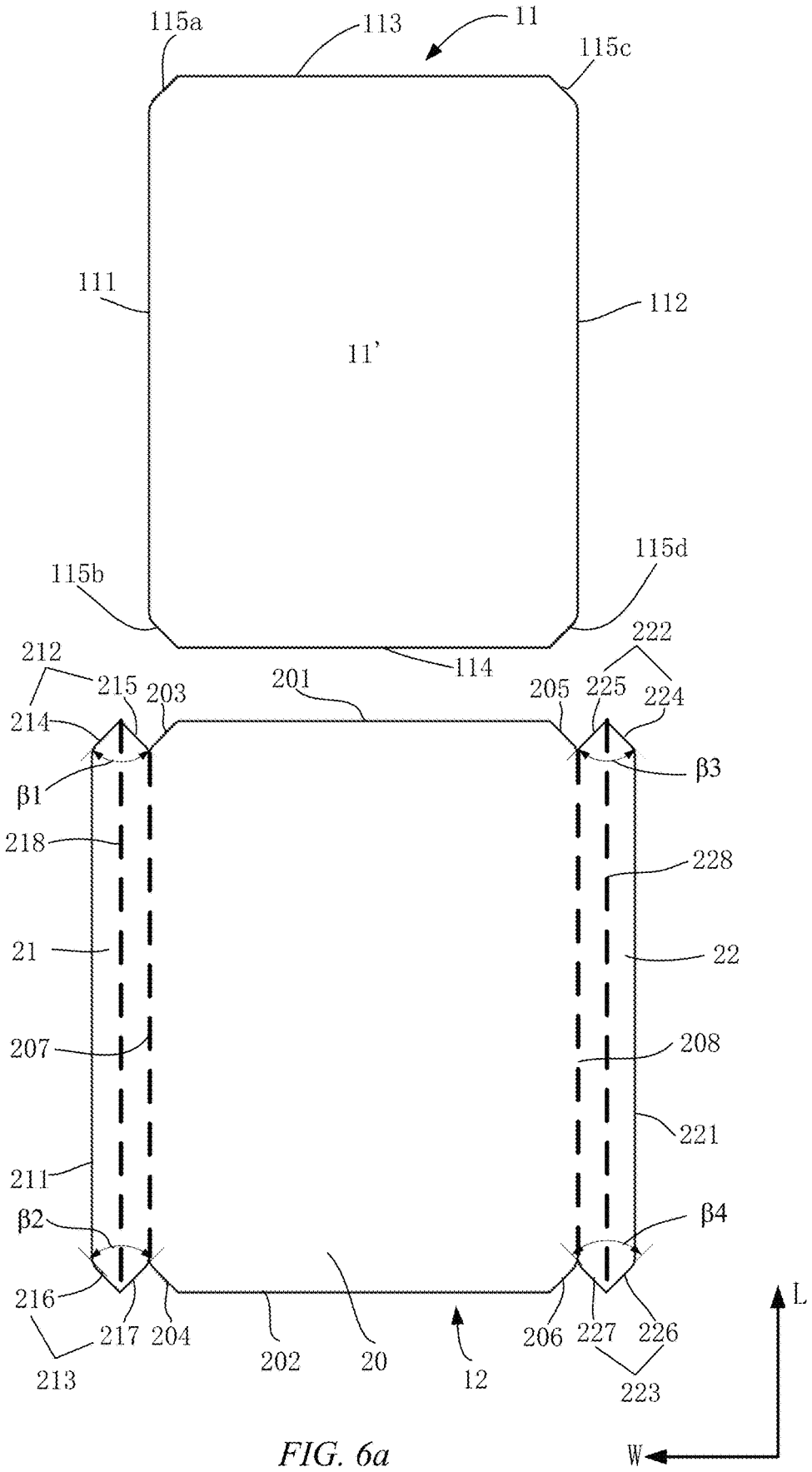
FIG. 6*a* is an expanded view of the inflatable mattress shown in FIG. 4, according to one or more embodiments shown and described herein.

Referring now to FIGS. 4, 5 and 6*a*, the inflatable mattress of the second embodiment is similar to the inflatable mattress of the first embodiment. The main difference between the two embodiments is in that the first and second side elements are not independent sheets, but a first side portion 21 and a second side portion 22 connected to the edges of the main portion 20 of the second sheet 12. For the sake of simplicity, only the differences between the two embodiments will be described below.

As shown in FIG. 6*a*, a first sheet 11 is substantially rectangular and includes a first edge 111, a second edge 112, a third edge 113 and a fourth edge 114. The first sheet 11 further includes a first chamfered edge 115*a*, a second chamfered edge 115*b*, a third chamfered edge 115*c* and a fourth chamfered edge 115*d*. The first edge 111 of the first sheet 11 and the second edge 112 of the first sheet 11 extend in a length direction L of the inflatable mattress 10 (i.e., the first edge 111 of the first sheet and the second edge 112 of the first sheet 11 are formed as two length edges of the first sheet 11). The third edge 113 of the first sheet 11 and the fourth edge 114 of the first sheet 11 substantially extend in the width direction W of the inflatable mattress 10 (i.e., the third edge 113 of the first sheet 11 and the fourth edge 114 of the first sheet 11 are formed as two width edges of the first sheet 11).

A second sheet 12 includes a main portion 20, a first side portion 21 and a second side portion 22. The main portion 20 of the second sheet 12 is substantially rectangular, a width direction of the main portion 20 runs substantially in the width direction W of the inflatable mattress 10, and a length direction of the main portion 20 runs substantially in the length direction L of the inflatable mattress 10. The first side portion 21 and the second side portion 22 are connected to two sides of the main portion 20 in the width direction. The first side portion 21 extends in the length direction of the main portion 20. The second side portion 22 extends in the length direction of the main portion 20. For example, a first folding axis 207 is provided between the first side portion 21 and the main portion 20. Said first folding axis 207 corresponds both to the second edge of the first side element and to a first edge of the main portion 20 of the second sheet 12. A second folding axis 208 is provided between the second side portion 22 and the main portion 20. Said second folding axis 208 corresponds to the second edge of the second side element and to the second edge of the main portion 20 of the second sheet 12. It should be understood that the first side portion 21 and the second side portion 22 may also be connected to two sides of the main portion 20 in the length direction. That is, the first side portion 21 can extend in the width direction of the main portion 20. The second side portion 22 can also extend in the width direction of the main portion 20.

The main portion 20 has a first width edge 201 and a second width edge 202 opposite the first edge 201. The first width edge 201 of the main portion 20 and the second width edge 202 of the main portion 20 are two width edges of the main portion 20. The two width edges 201, 202 substantially correspond to the third and fourth edges 123, 124 of the main portion 12' of the second sheet 12 of the first embodiment. In addition, the main portion 20 further has a first chamfered edge 203. In some embodiments, the main portion 20 further has a second chamfered edge 204 and a third chamfered edge 205, and a fourth chamfered edge 206. The first chamfered edge 203 of the main portion 20 and the third chamfered edge 205 of the main portion 20 are respectively connected to two ends of the first width edge 201 of the main portion 20, and the second chamfered edge 204 of the main portion 20 and the fourth chamfered edge 206 of the main portion 20 are respectively connected to two ends of the second width edge 202 of the main portion 20.

The first side portion 21 is similar to the first side sheet 14 of the inflatable mattress of the first embodiment. For example, the first side portion 21 has an outer edge 211, a first end portion 212 and a second end portion 213. The first end portion 212 of the first side portion 21 includes a first beveled edge 214 and a third beveled edge 215 connected to each other. The first beveled edge 214 of the first side portion 21 is equal to the first chamfered edge 115*a* of the first sheet 11 in length. The third beveled edge 215 of the first side portion 21 is equal to the first chamfered edge 203 of the second sheet 12 in length. Further, the first beveled edge 214 of the first side portion 21, the first chamfered edge 115*a* of the first sheet 11, the third beveled edge 215 of the first side portion 21, and the first chamfered edge 203 of the second sheet 12 are equal in length.

In some embodiments, a first angle β1 is formed between the first beveled edge 214 and the third beveled edge 215 of the first side portion 21, such that the first end portion 212 of the first side portion 21 is in a substantially sharp-cornered shape. In some embodiments, the first angle β1 of the first side portion 21 may be less than or equal to 160°. Further, the first angle β1 of the first side portion 21 is a right angle.

The second end portion 213 of the first side portion 21 includes a second beveled edge 216 and a fourth beveled edge 217 connected to each other. The first beveled edge 214 of the first side portion 21 and the second beveled edge 216 of the first side portion 21 are respectively connected to two ends of the first edge 211 of the first side portion 21. The second beveled edge 216 of the first side portion 21 is equal to the second chamfered edge 115*b* of the first sheet 11 in length. The fourth beveled edge 217 of the first side portion 21 is equal to the second chamfered edge 204 of the second sheet 12 in length. Further, the second beveled edge 216 of the first side portion 21, the second chamfered edge 115*b* of the first sheet 11, the fourth beveled edge 217 of the first side portion 21, and the second chamfered edge 204 of the second sheet 12 are equal in length.

In some embodiments, a second angle β2 is formed between the second beveled edge 216 and the fourth beveled edge 217 of the first side portion 21, such that the second end portion 213 of the first side portion 21 is in a substantially sharp-cornered shape. In some embodiments, the second angle β2 of the first side portion 21 may be less than or equal to 160°. Further, the second angle β2 of the first side portion 21 is a right angle.

In the embodiment shown in FIG. 6*a*, the first side portion 21 has a third folding axis 218 extending from the first end portion 212 to the second end portion 213. The parts of the first side portion 21 at two sides of the third folding axis 218 are symmetrical to each other.

The shape of the second side portion 22 is the same as that of the first side portion 21. For example, the second side portion 22 has an outer edge 221, a first end portion 222, and a second end portion 223. The first end portion 222 of the second side portion 22 includes a first beveled edge 224 and a third beveled edge 225 connected to each other. The first beveled edge 224 of the second side portion 22 is equal to the third chamfered edge 115*c* of the first sheet 11 in length. The third beveled edge 225 of the second side portion 22 is equal to the third chamfered edge 205 of the second sheet 12 in length. Further, the first beveled edge 224 of the second side portion 22, the third chamfered edge 115*c* of the first sheet 11, the third beveled edge 225 of the second side portion 22, and the third chamfered edge 205 of the second sheet 12 are equal in length.

In some embodiments, a third angle β3 is formed between the first beveled edge 224 of the second side portion 22 and the third beveled edge 225 of the second side portion 22, such that the first end portion 222 of the second side portion 22 is in a substantially sharp-cornered shape. In some embodiments, the third angle β3 of the second side portion 22 may be less than or equal to 160°. Further, the third angle β3 of the second side portion 22 may be a right angle.

The second end portion 223 of the second side portion 22 includes a second beveled edge 226 and a fourth beveled edge 227 connected to each other. The first beveled edge 224 of the second side portion 22 and the second beveled edge 226 of the second side portion 22 are respectively connected to two ends of the first edge 221 of the second side portion 22. The second beveled edge 226 of the second side portion 22 is equal to the fourth chamfered edge 115*d* of the first sheet 11 in length. The fourth beveled edge 227 of the second side portion 22 is equal to the fourth chamfered edge 206 of the second sheet 12 in length. Further, the second beveled edge 226 of the second side portion 22, the fourth chamfered edge 115*d* of the first sheet 11, the fourth beveled edge 227 of the second side portion 22, and the fourth chamfered edge 206 of the second sheet 12 are equal in length.

In some embodiments, a fourth angle β4 is formed between the second beveled edge 226 of the second side portion 22 and the fourth beveled edge 227 of the second side portion 22, such that the second end portion 223 of the second side portion 22 is in a substantially sharp-cornered shape. In some embodiments, the fourth angle β4 of the second side portion 22 may be less than or equal to 160°. Further, the fourth angle β4 of the second side portion may be a right angle.

In the embodiment shown in FIG. 6*a*, the second side portion 22 has a fourth folding axis 228 extending from the first end portion 222 of the second side portion 22 to the second end portion 223 of the second side portion 22. The parts of the second side portion 22 at two sides of the fourth folding axis 228 are symmetrical to each other.

Therefore, the inflatable mattress 10 according to this embodiment may comprise: the first sheet 11 fully defined by its main portion and provided with a first edge 111, a second edge 112, a third edge 113 and a fourth edge 114 connected each to the adjacent one by means of a first chamfered edge 115*a*, a second chamfered edge 115*b*, a third chamfered edge 115*c* and a fourth chamfered edge 115*d*; second sheet 12 comprising a main portion 20 made in one piece with a first side portion 21, defining the first side element 14, and a second side portion 22, defining the second side element 15.

The main portion 20 of the second sheet 12 may comprise: a first edge, defined by the folding axis 207; a second edge, defined by the folding axis 208; a third edge, defined by the first width edge 201; a fourth edge, defined by the second width edge 202.

The first side portion 21 may comprise: a first edge, defined by the outer edge 211; a second edge, defined by the folding axis 207; a first end portion 212 comprising a first beveled edge 214 and a third beveled edge 215; a second end portion 213 comprising a second beveled edge 216 and a fourth beveled edge 217.

The second side portion 22 may comprise: a first edge, defined by the outer edge 221; a second edge, defined by the folding axis 208; a first end portion 222 comprising a first beveled edge 224 and a third beveled edge 225; a second end portion 223 comprising a second beveled edge 226 and a fourth beveled edge 227.

Figure 6B:
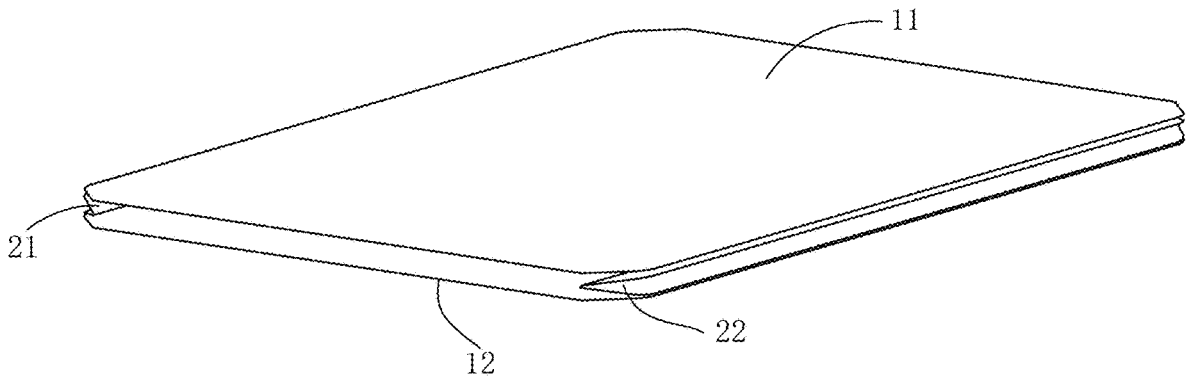
FIG. 6*b* schematically shows a manufacturing process of the inflatable mattress shown in FIG. 4, according to one or more embodiments shown and described herein.

When the inflatable mattress 10 is manufactured, referring to FIGS. 6*a* and 6*b*, the first side portion 21 is folded toward the main portion 20 along the first folding axis 207. The first side portion 21 is folded along the third folding axis 218. The second side portion 22 is folded toward the main portion 20 along the second folding axis 208. The second side portion 22 is folded along the fourth folding axis 228. The third beveled edge 215 of the first side portion 21 is adjacent to and aligned with the first chamfered edge 203 of the main portion 20. The fourth beveled edge 217 of the first side portion 21 is adjacent to and aligned with the second chamfered edge 204 of the main portion 20. The third beveled edge 225 of the second side portion 22 is adjacent to and aligned with the third chamfered edge 205 of the main portion 20. The fourth beveled edge 227 of the second side portion 22 is adjacent to and aligned with the fourth chamfered edge 206 of the main portion 20. In this way, the second sheet 12 is folded into a substantially planar shape. The first sheet 11 and the second sheet 12 are then stacked together. The first width edge 201 of the main portion 20 overlaps the third edge 113 of the first sheet 11. The second width edge 202 of the main portion 20 overlaps the fourth edge 114 of the first sheet 11. The first edge 211 of the first side portion 21 overlaps the first edge 111 of the first sheet 11. The first edge 221 of the second side portion 22 overlaps the second edge 112 of the first sheet 11. The first beveled edge 214 of the first side portion 21 overlaps the first chamfered edge 115*a* of the first sheet 11. The second beveled edge 216 of the first side portion 21 overlaps the second chamfered edge 115*b* of the first sheet 11. The first beveled edge 224 of the second side portion 22 overlaps the third chamfered edge 115*c* of the first sheet 11 The second beveled edge 226 of the second side portion 22 overlaps the fourth chamfered edge 115*d* of the first sheet 11. On the whole, the first sheet 11 and the second sheet 12 are both in a substantially planar state and are stacked, such that the welding operation is performed only on the corresponding edges of the first sheet 11 and the second sheet 12 in the substantially planar state. Similar to the first embodiment, with regard to a manufacturing process for the mattress structure of the second embodiment, the step of manually fixing the side sheets to a welding mold is omitted, such that a welding process is greatly simplified, and errors caused by the manual operation are avoided. After a welding apparatus in an automatic device performs the welding operation on the first sheet and the second sheet, the third beveled edge 215 of the first side portion is connected to the first chamfered edge 203 of the main portion 20. The fourth beveled edge 217 of the first side portion 21 is connected to the second chamfered edge 204 of the main portion 20. The third beveled edge 225 of the second side portion 22 is connected to the third chamfered edge 205 of the main portion 20. The fourth beveled edge 227 of the second side portion 22 is connected to the fourth chamfered edge 206 of the main portion 20. The first width edge 201 of the main portion 20 is connected to the third edge 113 of the first sheet 11. The second width edge 202 of the main portion 20 is connected to the fourth edge 114 of the first sheet 11. The outer edge 211 of the first side portion 21 is connected to the first edge 111 of the first sheet 11. The outer edge 221 of the second side portion 22 is connected to the second edge 112 of the first sheet 11. The first beveled edge 214 of the first side portion 21 is connected to the first chamfered edge 115*a* of the first sheet 11. The second beveled edge 216 of the first side portion 21 is connected to the second chamfered edge 115*b* of the first sheet 11. The first beveled edge 224 of the second side portion 22 is connected to the third chamfered edge 115*c* of the first sheet 11. The second beveled edge 226 of the second side portion 22 is connected to the fourth chamfered edge 115*d* of the first sheet 11.

The number of seams in the inflatable mattress 10 is decreased, which simplifies the manufacture of the inflatable mattress 10, and is conducive to decreasing manufacturing errors, thereby reducing the reject ratio of the inflatable mattress 10. In addition, since the number of the seams is decreased, there is no need to reserve connection margins for the seams when a material is prepared, which is in turn conducive to improving the utilization rate of the material.

It should be understood that the first side portion 21 and the second side portion 22 may also be made of the same piece of material as the first sheet 11. Alternatively, one of the first side portion 21 and the second side portion 22 is made of the same piece of material as the first sheet 11, and the other of the first side portion 21 and the second side portion 22 is made of the same piece of material as the second sheet 12. Details will not be described herein again.

Figure 7:
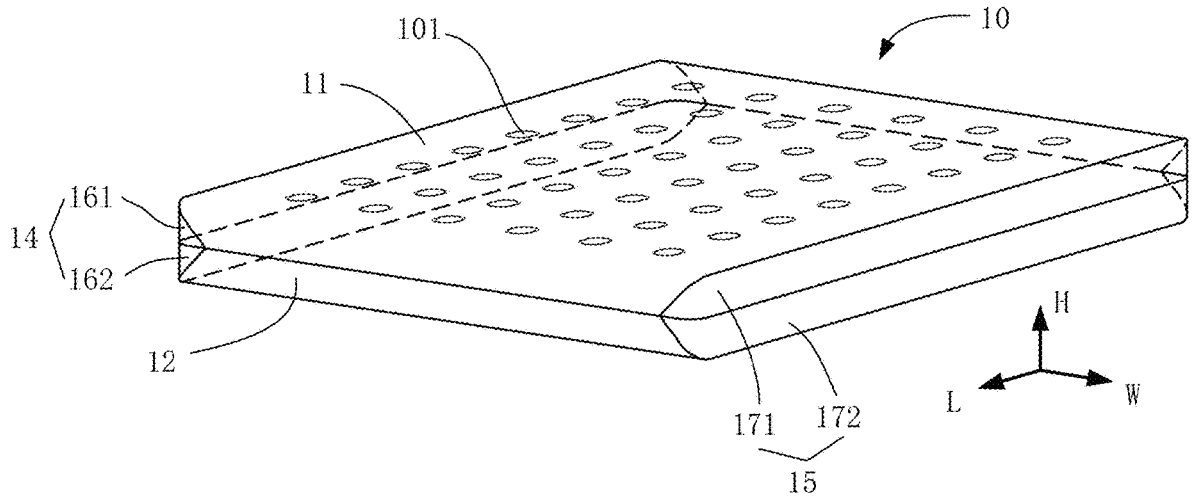
FIG. 7 schematically shows a third embodiment of an inflatable mattress according to one or more embodiments shown and described herein.
Figure 8A:
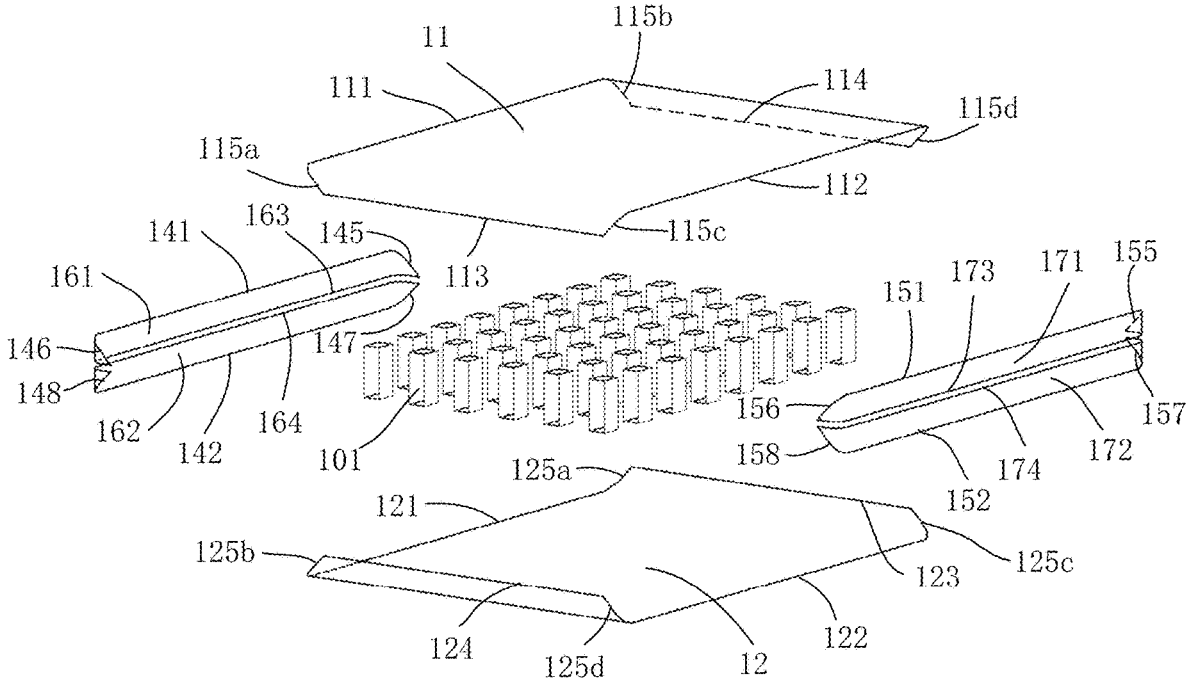
FIG. 8*a* is an exploded view of the inflatable mattress of FIG. 7, according to one or more embodiments shown and described herein.
Figure 8B:
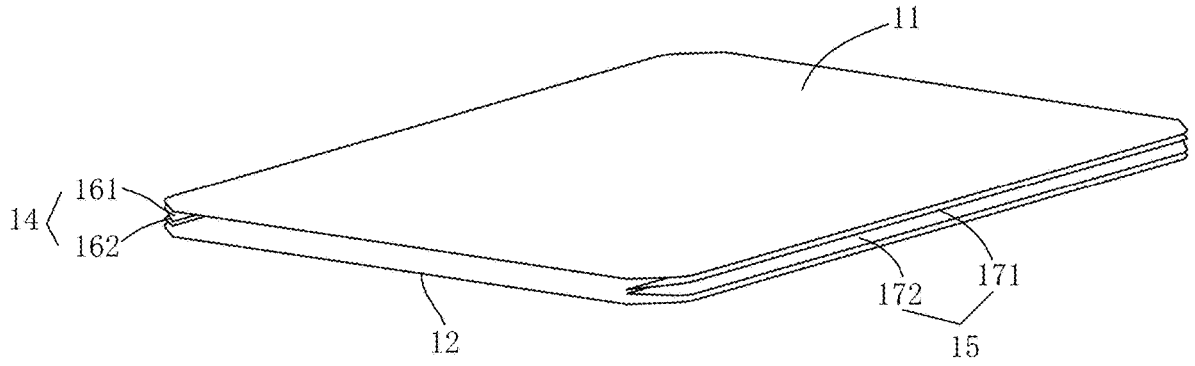
FIG. 8*b* schematically shows a manufacturing process of the inflatable mattress shown in FIG. 7, according to one or more embodiments shown and described herein.

Referring now to FIGS. 7-8B, the inflatable mattress of the third embodiment is similar to the inflatable mattress of the first embodiment. For the sake of simplicity, only the differences between the two embodiments will be described below.

Generally speaking, the third embodiment is substantially equal to the first one, with the side elements defined by side sheets each comprising a first side sub-sheet connected to a second side sub-sheet along a joining line.

As shown in FIG. 7, a first side sheet 14 includes a first side sub-sheet 161 and a second side sub-sheet 162. The first side sub-sheet 161 and the second side sub-sheet 162 have the same shape and are equal in size.

As shown in FIG. 8*a*, the first side sub-sheet 161 includes a first edge 141 of the first side sheet 14, a first beveled edge 145 of the first side sheet 14, a second beveled edge 146 of the first side sheet 14, and a joining edge 163. Two ends of the joining edge 163 of the first side sub-sheet 161 are respectively connected to the first beveled edge 145 of the first side sheet 161 and the second beveled edge 146 of the first side sheet 161. The second side sub-sheet 162 includes a second edge 142 of the first side sheet 14, a third beveled edge 147 of the first side sheet 14, a fourth beveled edge 148 of the first side sheet 14, and a joining edge 164. Two ends of the joining edge 164 of the second side sub-sheet 161 are respectively connected to the third beveled edge 147 of the first side sheet 14 and the fourth beveled edge 148 of the first side sheet 14.

Further, as shown in FIG. 8*a*, a second side sheet 15 includes a third side sub-sheet 171 and a fourth side sub-sheet 172. The third side sub-sheet 171 includes a first edge 151 of the second side sheet 15, a first beveled edge 155 of the second side sheet 15, a second beveled edge 156 of the second side sheet 15, and a joining edge 173. The joining edge 173 of the third side sub-sheet 171 is connected to each of the first beveled edge 155 of the second side sheet 15 and the second beveled edge 156 of the second side sheet 15. The fourth side sub-sheet 172 includes a second edge 152 of the second side sheet 15, a third beveled edge 157 of the second side sheet 15, a fourth beveled edge 158 of the second side sheet 15, and a joining edge 174. The joining edge 174 of the fourth side sub-sheet 172 is connected to each of the third beveled edge 157 of the second side sheet 15 and the fourth beveled edge 158 of the second side sheet 15.

Referring to FIGS. 8*a* and 8*b*, during the manufacture of the inflatable mattress 10, the joining edge 163 of the first side sub-sheet 161 is connected to the joining edge 164 of the second side sub-sheet 162, such that a first sub-sheet body 161 and a second sub-sheet body 162 are connected into a whole to serve as the first side sheet 14. Then, similar to the first embodiment, the first side sheet 14 is folded in half, along a seam between the first side sub-sheet 161 and the second side sub-sheet 162, into a substantially planar shape. Similarly, the joining edge 173 of the third side sub-sheet 171 and the joining edge 174 of the fourth side sub-sheet 172 are connected, such that the third side sub-sheet 171 and the fourth side sub-sheet 172 are connected into a whole to serve as the second side sheet 15. Then, similar to the first embodiment, the second side sheet 15 is folded in half, along a seam between the third side sub-sheet 171 and the fourth side sub-sheet 172, into a substantially planar shape.

Next, as in the case of manufacturing the inflatable mattress of the first embodiment, the first sheet 11 and the second sheet 12 are stacked. The first side sheet 14 folded into the substantially planar shape and the second side sheet 15 folded into the substantially planar shape are arranged between the first sheet 11 and the second sheet 12. In this way, a connecting operation on the first sheet 11, the second sheet 12, the first side sheet 14 and the second side sheet 15 can be completed substantially in a plane by using an automatic device.

Figure 9:
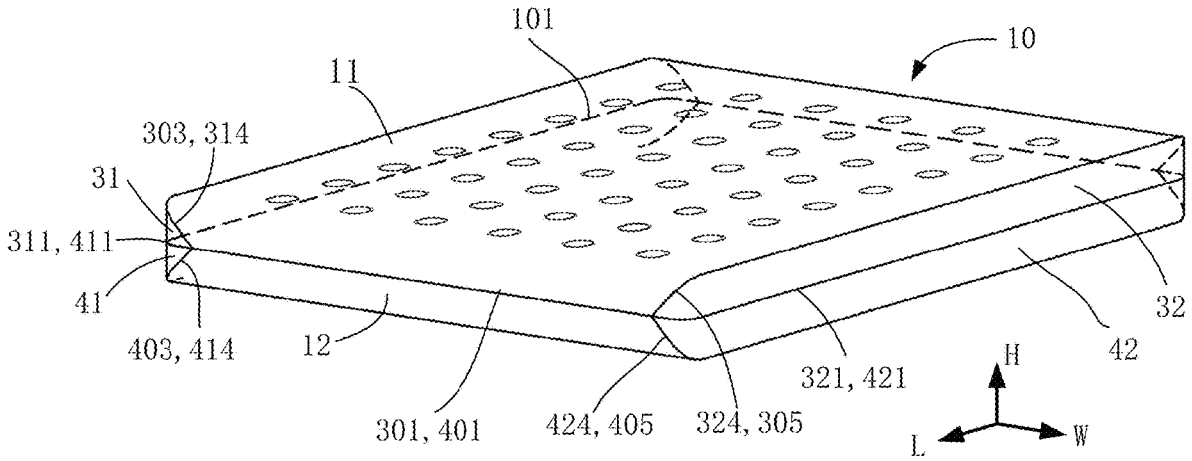
FIG. 9 schematically shows a fourth embodiment of an inflatable mattress according to one or more embodiments shown and described herein.
Figure 10:
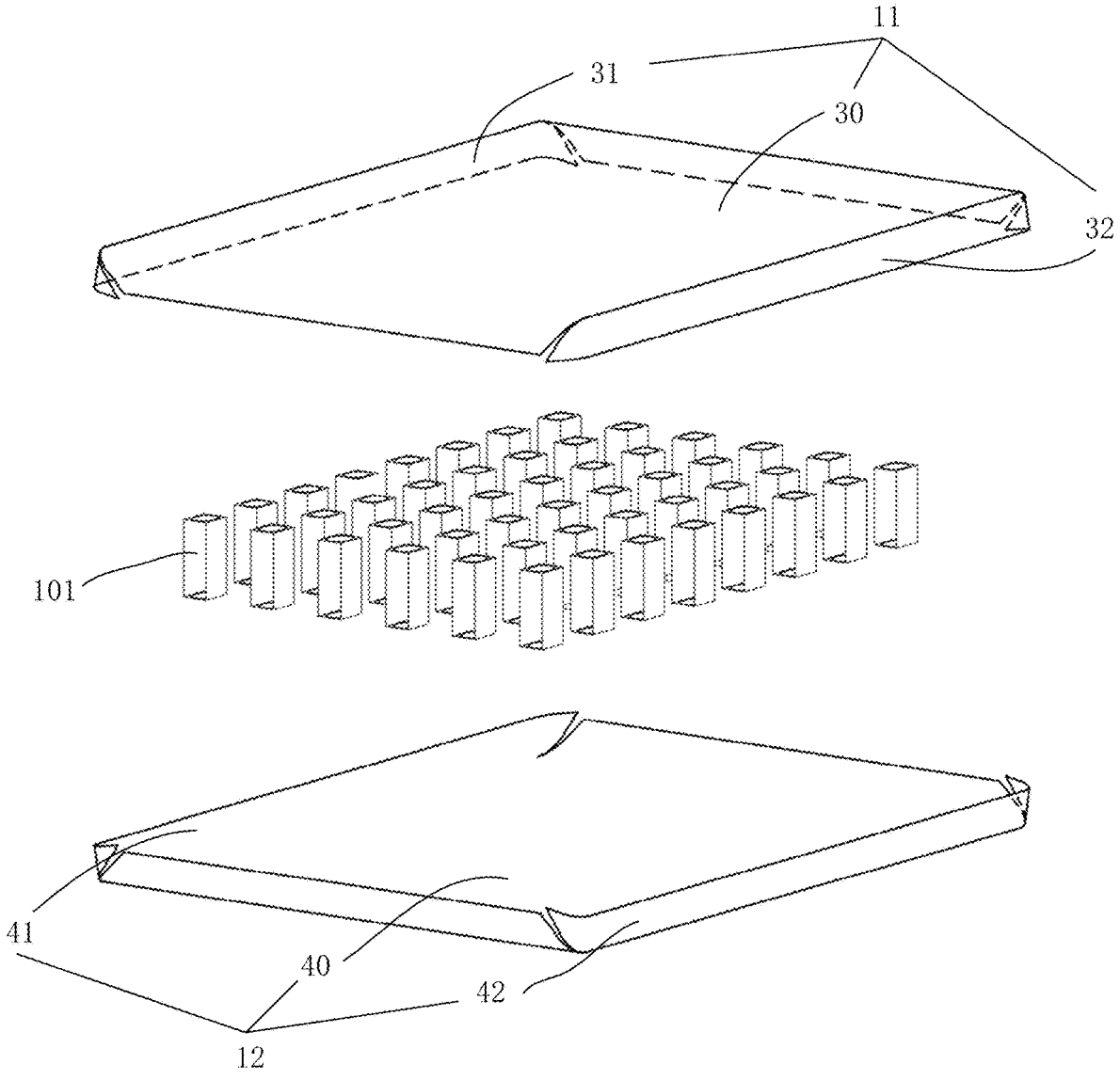
FIG. 10 is an exploded view of the inflatable mattress of FIG. 9, according to one or more embodiments shown and described herein.

Turning now to FIGS. 9 and 10, an inflatable mattress 10 of the fourth embodiment is depicted. The inflatable mattress 10 of the fourth embodiment includes a first sheet 11 and a second sheet 12. The first sheet 11 and the second sheet 12 are arranged opposite each other and connected together.

The fourth embodiment discloses an inflatable mattress 10 similar to the one of the second embodiment, but with the side portions divided each in two semi-side portions 31, 41, 32, 42, one connected made in one piece with the first or second edge of the main portion 30 of first sheet 11 and the other made in one piece with the first or second edge of the main portion 40 of second sheet 12.

Figure 11A:
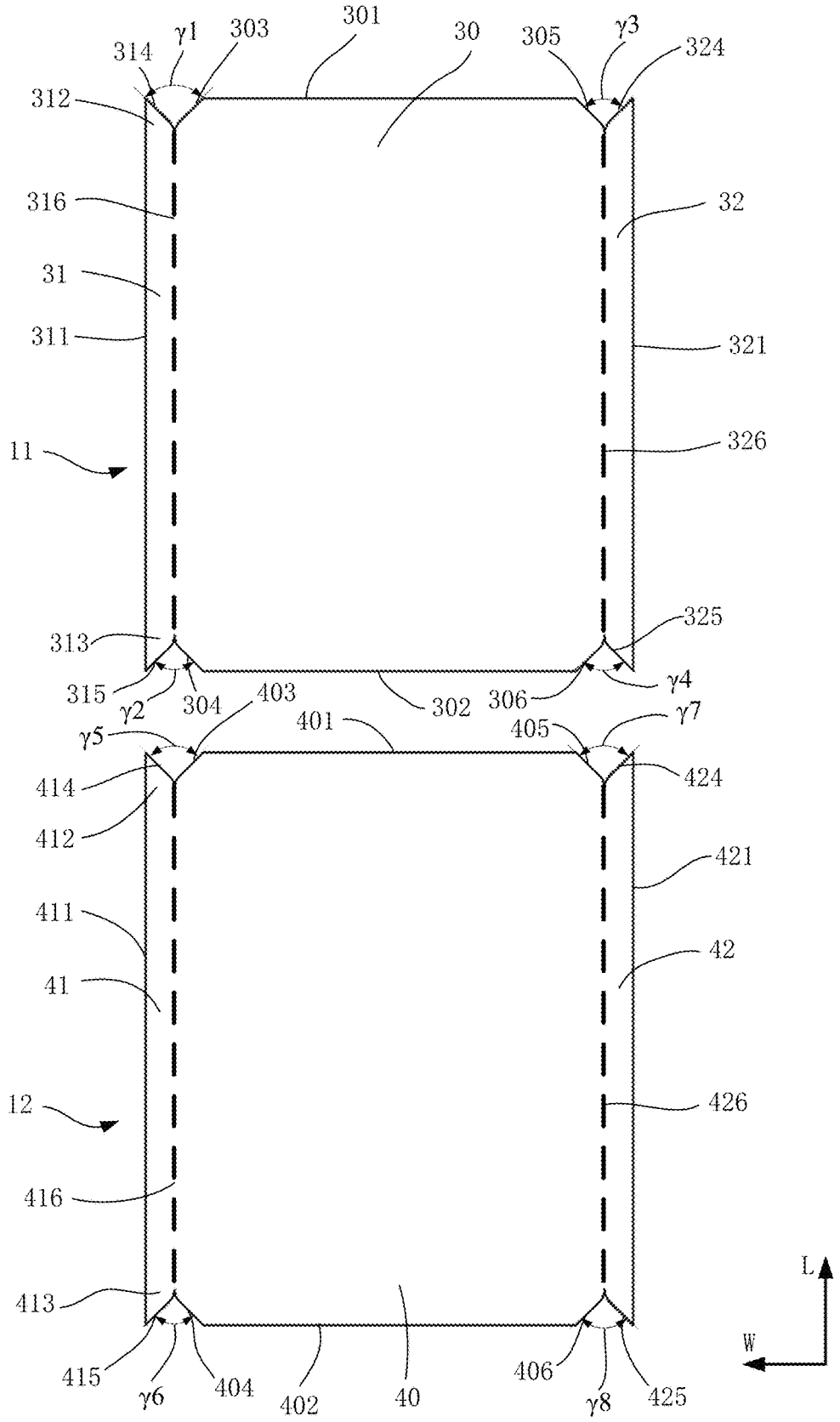
FIG. 11*a* is an expanded view of the inflatable mattress in FIG. 9, according to one or more embodiments shown and described herein.

As shown in FIG. 11*a*, the first sheet 11 includes a main portion 30, a first side portion 31 and a second side portion 32. The main portion 30 of the first sheet 11 is substantially rectangular, a width direction of the main portion 30 of the first sheet 11 runs substantially in the width direction W of the inflatable mattress 10, and a length direction of the main portion 30 of the first sheet 11 runs substantially in the length direction L of the inflatable mattress 10. The first side portion 31 of the first sheet 11 and the second side portion 32 of the first sheet 11 are connected to two sides of the main portion 30 of the first sheet 11 in the width direction. In other words, the first side portion 31 of the first sheet 11, the second side portion 32 of the first sheet 11 and the main portion 30 of the first sheet 11 are made of the same piece of material. A first folding axis 316 is provided between the first side portion 31 of the first sheet 11 and the main portion 30 of the first sheet 11. The first folding 316 axis corresponds both to the first edge of the main portion 30 of the first sheet 11 and to the first edge of the first side element. A second folding axis 326 is provided between the second side portion 32 of the first sheet 11 and the main portion 30 of the first sheet 11. The second folding axis 326 corresponds both to the second edge of the main portion 30 of the first sheet 11 and to the first edge of the second side element. It should be understood that, in an alternative embodiment, the first side portion 31 of the first sheet 11 and the second side portion 32 of the first sheet 11 may be connected to two sides of the main portion 30 of the first sheet 11 in the length direction.

The main portion 30 of the first sheet 11 has a first width edge 301 and a second width edge 302. The first width edge 301 of the main portion 30 of the first sheet 11 and the second width edge 302 of the main portion 30 of the first sheet 11 are opposite each other and are two width edges of the main portion 30 of the first sheet. In addition, the main portion 30 of the first sheet 11 further has a first chamfered edge 303, a second chamfered edge 304, a third chamfered edge 305, and a fourth chamfered edge 306. The first chamfered edge 303 of the main portion 30 of the first sheet 11 and the third chamfered edge 305 of the main portion 30 of the first sheet 11 are respectively connected to two ends of the first edge 301 of the main portion 30 of the first sheet 11. The second chamfered edge 304 of the main portion 30 of the first sheet 11 and the fourth chamfered edge 306 of the main portion 30 of the first sheet 11 are respectively connected to two ends of the second edge 302 of the main portion 30 of the first sheet 11.

The first side portion 31 of the first sheet 11 extends in the length direction L of the inflatable mattress 10 and has an outer edge 311 extending substantially in the length direction L of the inflatable mattress 10. The outer edge 311 of the first side portion 31 corresponds to a joining edge of the first side portion 31 of the first sheet 11 with a first side portion 41 of the second sheet 12. The first side portion 31 of the first sheet 11 further has a first end portion 312 and a second end portion 313 opposite the first end portion 312. The first side portion 31 of the first sheet 11 has a first beveled edge 314, and two ends of the first beveled edge 314 of the first side portion 31 of the first sheet 11 are respectively connected to the outer edge 311 of the first side portion 31 of the first sheet 11 and the first chamfered edge 303 of the main portion 30 of the first sheet 11. The first beveled edge 314 of the first side portion 31 of the first sheet 11 and the first chamfered edge 303 of the first sheet 11 are equal in length and are symmetrical to each other with respect to the first folding axis 316 of the first sheet 11. A first angle $\gamma 1$ is formed between the first beveled edge 314 of the first side portion 31 of the first sheet 11 and the first chamfered edge 303 of the main portion 30 of the first sheet 11. In some embodiments, the first angle $\gamma 1$ of the first sheet 11 is greater than or equal to 160°. Further, the first angle $\gamma 1$ of the first sheet 11 may be a right angle.

The second end portion 313 of the first side portion 31 of the first sheet 11 has a second beveled edge 315. Two ends of the second beveled edge 315 of the first side portion 31 of the first sheet 11 are respectively connected to the outer edge 311 of the first side portion 31 of the first sheet 11 and the second chamfered edge 304 of the main portion 30 of the first sheet 11. The second beveled edge 315 of the first side portion 31 of the first sheet 11 is equal to the second chamfered edge 304 of the first sheet 11 in length. The second beveled edge 315 of the first side portion 31 of the first sheet 11 and the second chamfered edge 304 of the first sheet 11 are symmetrical to each other with respect to the first folding axis 316 of the first sheet 11. A second angle γ2 is formed between the second beveled edge 315 of the first side portion 31 of the first sheet 11 and the second chamfered edge 304 of the main portion 30 of the first sheet 11. In some embodiments, the second angle γ2 of the first sheet 11 is greater than or equal to 160°. Further, the second angle γ2 of the first sheet 11 may be a right angle.

The second side portion 32 of the first sheet 11 and the first side portion 31 of the first sheet 11 have the same shape, may be equal in size, and may also be in mirror symmetry. For example, the second side portion 32 of the first sheet 11 includes an outer edge 321, a first beveled edge 324, and a second beveled edge 325. The outer edge 321 of the second side portion 32 corresponds to a joining edge of the second side portion 32 of the first sheet 11 with a second side portion 42 of the second sheet 40. Two ends of the first beveled edge 324 of the second side portion 32 of the first sheet 11 are respectively connected to the outer edge 321 of the second side portion 32 of the first sheet 11 and the third chamfered edge 305 of the main portion 30 of the first sheet 11. The first beveled edge 324 of the second side portion 32 of the first sheet 11 and the third chamfered edge 305 of the main portion 30 of the first sheet 11 are equal in length and are symmetrical to each other with respect to the second folding axis 326 of the first sheet 11. A third angle γ3 is formed between the first beveled edge 324 of the second side portion 32 of the first sheet 11 and the third chamfered edge 305 of the main portion 30 of the first sheet 11. In some embodiments, the third angle γ3 of the first sheet 11 is greater than or equal to 160°. Further, the third angle γ3 of the first sheet 11 may be a right angle.

Two ends of the second beveled edge 325 of the second side portion 32 of the first sheet 11 are respectively connected to the outer edge 321 of the second side portion 32 of the first sheet 11 and the fourth chamfered edge 306 of the main portion 30 of the first sheet 11. The second beveled edge 325 of the second side portion 32 of the first sheet 11 and the fourth chamfered edge 306 of the main portion 30 of the first sheet 11 are equal in length and may also be symmetrical to each other with respect to the second folding axis 326 of the first sheet 11. A fourth angle γ4 is formed between the second beveled edge 325 of the second side portion 32 of the first sheet 11 and the fourth chamfered edge 306 of the main portion 30 of the first sheet 11. In some embodiments, the fourth angle γ4 of the first sheet 11 is greater than or equal to 160°. Further, the fourth angle γ4 of the first sheet 11 may be a right angle.

The shape of the second sheet 12 is the same as that of the first sheet 11. For example, the second sheet 12 includes a main portion 40, a first side portion 41 and a second side portion 42. A first folding axis 416 is provided between the first side portion 41 of the second sheet 12 and the main portion 40 of the second sheet 12. A second folding axis 426 is provided between the second side portion 42 of the second sheet 12 and the main portion 40 of the second sheet 12.

The first folding 416 axis corresponds both to the first edge of the main portion 40 of the second sheet 11 and to the second edge of the first side element.

The second folding 426 axis corresponds both to the second edge of the main portion 40 of the second sheet 11 and to the second edge of the second side element.

The main portion 40 of the second sheet 12 has a first width edge 401 and a second width edge 402. The first width edge 401 of the main portion 40 of the second sheet 12 and the second width edge 402 of the main portion 40 of the second sheet 12 are opposite each other and are two width edges of the main portion 40 of the second sheet 12. The main portion 40 of the second sheet 12 further has a first chamfered edge 403, a second chamfered edge 404, a third chamfered edge 405, and a fourth chamfered edge 406. The first chamfered edge 403 of the main portion 40 of the second sheet 12 and the third chamfered edge 405 of the main portion 40 of the second sheet 12 are respectively connected to two ends of the first width edge 401 of the main portion 40 of the second sheet 12. The second chamfered edge 404 of the main portion 40 of the second sheet 12 and the fourth chamfered edge 406 of the main portion 40 of the second sheet 12 are respectively connected to two ends of the second width edge 402 of the main portion 40 of the second sheet 12.

The first side portion 41 of the second sheet 12 has an outer edge 411 extending substantially in the length direction L of the inflatable mattress 10. The outer edge 411 of the first side portion 41 of the second sheet 12 corresponds to a joining edge of the first side portion 41 of the second sheet 12 with the first side portion 31 of the first sheet 11. The first side portion 41 of the second sheet 12 further has a first end portion 412 and a second end portion 413 opposite the first end portion 412. The first end portion 412 of the first side portion 41 of the second sheet 12 has a first beveled edge 414, and two ends of the first beveled edge 414 of the first side portion 41 of the second sheet 12 are respectively connected to the outer edge 411 of the first side portion 41 of the second sheet 12 and the first chamfered edge 403 of the main portion 40 of the second sheet 12. The first beveled edge 414 of the first side portion 41 of the second sheet 12 is equal to the first chamfered edge 403 of the main portion 40 of the second sheet 12 in length, and may also be symmetrical to each other with respect to the first folding axis 416 of the second sheet 12. A fifth angle γ5 is formed between the first beveled edge 414 of the first side portion 41 of the second sheet 12 and the first chamfered edge 403 of the main portion 40 of the second sheet 12. In some embodiments, the fifth angle γ5 of the second sheet 12 is greater than or equal to 160°. Further, the fifth angle γ5 of the second sheet 12 may be a right angle.

The second end portion 413 of the first side portion 41 of the second sheet 12 has a second beveled edge 415, and two ends of the second beveled edge 415 of the first side portion 41 of the second sheet 12 are respectively connected to the outer edge 411 of the first side portion 41 of the second sheet 12 and the second chamfered edge 404 of the main portion 40 of the second sheet 12. The second beveled edge 415 of the first side portion 41 of the second sheet 12 is equal to the second chamfered edge 404 of the main portion 40 of the second sheet 12 in length, and may also be symmetrical to each other with respect to the first folding axis 416 of the second sheet 12. A sixth angle γ6 is formed between the second beveled edge 415 of the first side portion 41 of the second sheet 12 and the second chamfered edge 404 of the main portion 40 of the second sheet 12. In some embodiments, the sixth angle γ6 of the second sheet 12 is greater than or equal to 160°. Further, the sixth angle γ6 of the second sheet 12 may be a right angle.

The second side portion 42 of the second sheet 12 and the first side portion 41 of the second sheet 12 have the same shape and may also be in mirror symmetry. For example, the second side portion 42 includes an outer edge 421, a first beveled edge 424, and a second beveled edge 425. Two ends of the first beveled edge 424 of the second side portion are respectively connected to the outer edge 421 of the second side portion 42 and the third chamfered edge 405 of the main portion 40 of the second sheet 12. The first beveled edge 424 of the second side portion 42 of the second sheet 12 is equal to the third chamfered edge 405 of the main portion 40 of the second sheet 12 in length, and may also be symmetrical to each other with respect to the second folding axis 426 of the second sheet 12. A seventh angle γ7 is formed between the first beveled edge 424 of the second side portion 42 of the second sheet 12 and the third chamfered edge 405 of the main portion 40 of the second sheet 12. In some embodiments, the seventh angle γ7 of the second sheet 12 is greater than or equal to 160°. Further, the included angle γ7 of the second sheet 12 may be a right angle.

Two ends of the second beveled edge 425 of the second side portion 42 of the second sheet 12 are respectively connected to the outer edge 421 of the second side portion 42 of the second sheet 12 and the fourth chamfered edge 406 of the main portion 40 of the second sheet 12. The second beveled edge 425 of the second side portion 42 of the second sheet 12 is equal to the fourth chamfered edge 406 of the main portion 40 of the second sheet 12 in length, and may also be symmetrical to each other with respect to the second folding axis 426 of the second sheet 12. An eighth angle γ8 is formed between the second beveled edge 425 of the second side portion 42 of the second sheet 12 and the fourth chamfered edge 406 of the main portion 40 of the second sheet 12. In some embodiments, the eighth angle γ8 of the second sheet 12 is greater than or equal to 160°. Further, the included angle γ8 of the second sheet 12 may be a right angle.

Therefore, the inflatable mattress 10 according to this embodiment may comprise: the first sheet 11 comprising a main portion 30 made in one piece with a first side portion 31 and a second side portion 32. The first side portion 31 partly defines the first side element 14 and corresponds, in shape, to the first sub-sheet 161 of the first side element 14. The second side portion 32 partly defines the second side element 15 and corresponds, in shape, to the first sub-sheet 171 of the second side element 15. The second sheet 12 comprising a main portion 40 made in one piece with a first side portion 41 and a second side portion 42. The first side portion 41 partly defines the first side element 14 and corresponds, in shape, to the second sub-sheet 162 of the first side element 14 in the previous embodiment. The second side portion 42 partly defines the second side element 15 and corresponds, in shape, to the second sub-sheet 172 of the second side element 15 in the previous embodiment.

The main portion 30 of the first sheet 11 may comprise: a first edge, defined by the folding axis 316; a second edge, defined by the folding axis 326; a third edge, defined by the first width edge 301; a fourth edge, defined by the second width edge 302.

The first side portion 31 may comprise: a first edge, defined by the folding axis 316 and corresponding to the first edge of the first side element 14; a joining edge, defined by the outer edge 311; a first end portion 312 comprising a first beveled edge 314; a second end portion 313 comprising a second beveled edge 315.

The second side portion 32 may comprise: a first edge, defined by the folding axis 326 and corresponding to the first edge of the second side element 15; a joining edge, defined by the outer edge 321; a first end portion comprising a first beveled edge 324; a second end portion comprising a second beveled edge 325.

The main portion 40 of the first sheet 12 may comprise: a first defined by the folding axis 416; a second edge, defined by the folding axis 426; a third edge, defined by the first width edge 301; a fourth edge, defined by the second width edge 302.

The first side portion 31 may comprise: a second edge, defined by the folding axis 416 and corresponding to the second edge of the second first element 14; a joining edge, defined by the outer edge 411; a first end portion 412 comprising a first beveled edge 414; a second end portion 413 comprising a second beveled edge 415.

The second side portion 32 may comprise: a first edge, defined by the folding axis 426 and corresponding to the second edge of the second side element 15; a joining edge, defined by the outer edge 421; a first end portion comprising a first beveled edge 424; a second end portion comprising a second beveled edge 425.

During the manufacture of the inflatable mattress 10, the first sheet 11 and the second sheet 12 are stacked and aligned, the outer edge 311 of the first side portion 31 of the first sheet 11 is then connected to the outer edge 411 of the first side portion 41 of the second sheet 11. The outer edge 321 of the second side portion 32 of the first sheet 11 is connected to the outer edge 421 of the second side portion 42 of the second sheet 12.

Figure 11B:
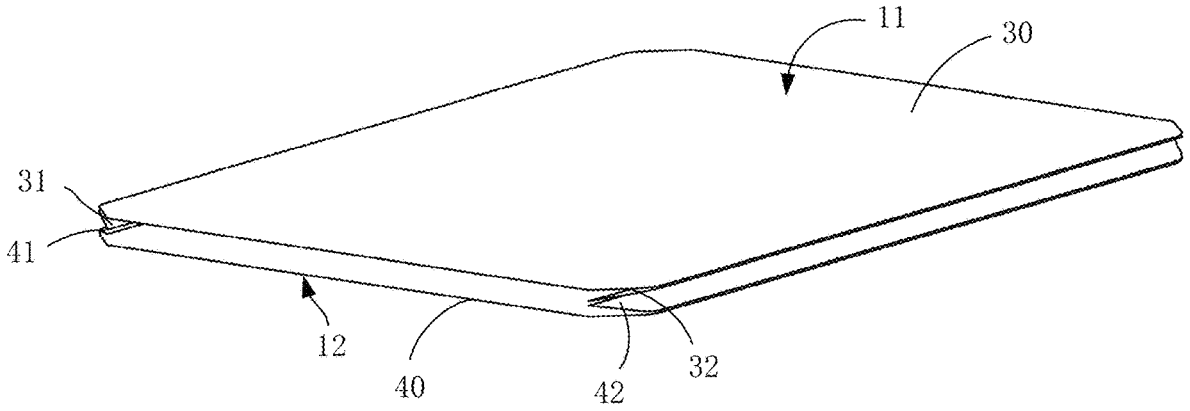
FIG. 11*b* schematically shows a manufacturing process of the inflatable mattress shown in FIG. 9, according to one or more embodiments shown and described herein.

Next, as shown in FIG. 11*b*, the first side portion 31 of the first sheet 11 and the first side portion 41 of the second sheet 12 are folded along a seam between the two side portions, and are folded into a space between the main portion 30 of the first sheet 11 and the main portion 40 of the second sheet 12 along the first folding axis 316 of the first sheet 11 and the first folding axis 416 of the second sheet 12. The second side portion 32 of the first sheet 11 and the second side portion 42 of the second sheet 12 are folded along a seam between the two side portions, and are folded into a space between the main portion 30 of the first sheet 11 and the main portion 40 of the second sheet 12 along the second folding axis 326 of the first sheet 11 and the second folding axis 426 of the second sheet 12. On the whole, the first sheet 11 and the second sheet 12 are substantially in the same plane. In this way, a connecting operation on the remaining edges can be completed substantially in the same plane by using an automatic device. After the connecting operation is completed, the first width edge 301 of the main portion 30 of the first sheet 11 is connected to the first width edge 401 of the main portion 40 of the second sheet 12. The second width edge 302 of the main portion 30 of the first sheet 11 is connected to the second width edge 402 of the main portion 40 of the second sheet 12. In addition, the first beveled edge 314 of the first side portion 31 of the first sheet 11 is connected to the first chamfered edge 303 of the main portion 30 of the first sheet 11. The second beveled edge 315 of the first side portion 31 of the first sheet 11 is connected to the second chamfered edge 304 of the main portion 30 of the first sheet 11. The first beveled edge 324 of the second side portion 32 of the first sheet 11 is connected to the third chamfered edge 305 of the main portion 30 of the first sheet 11. The second beveled edge 325 of the second side portion 32 of the first sheet 11 is connected to the fourth chamfered edge 306 of the main portion 30 of the first sheet 11. The first beveled edge 414 of the first side portion 41 of the second sheet 12 is connected to the first chamfered edge 403 of the main portion 40 of the second sheet 12. The second beveled edge 415 of the first side portion 41 of the second sheet 12 is connected to the second chamfered edge 404 of the main portion 40 of the second sheet 12. The first beveled edge 424 of the second side portion 42 of the second sheet 12 is connected to the third chamfered edge 405 of the main portion 40 of the second sheet 12. The second beveled edge 425 of the second side portion 40 of the second sheet 12 is connected to the fourth chamfered edge 406 of the main portion 40 of the second sheet 12.

According to the inflatable mattress of the fourth embodiment, the number of scams in the inflatable mattress 10 is decreased, which simplifies the manufacture of the inflatable mattress 10, and is conducive to decreasing manufacturing errors, thereby reducing the reject ratio of the inflatable mattress 10. In addition, since the number of the seams is decreased, there is no need to reserve connection margins for the seams when a material is prepared, which is in turn conducive to improving the utilization rate of the material.

Figure 12:
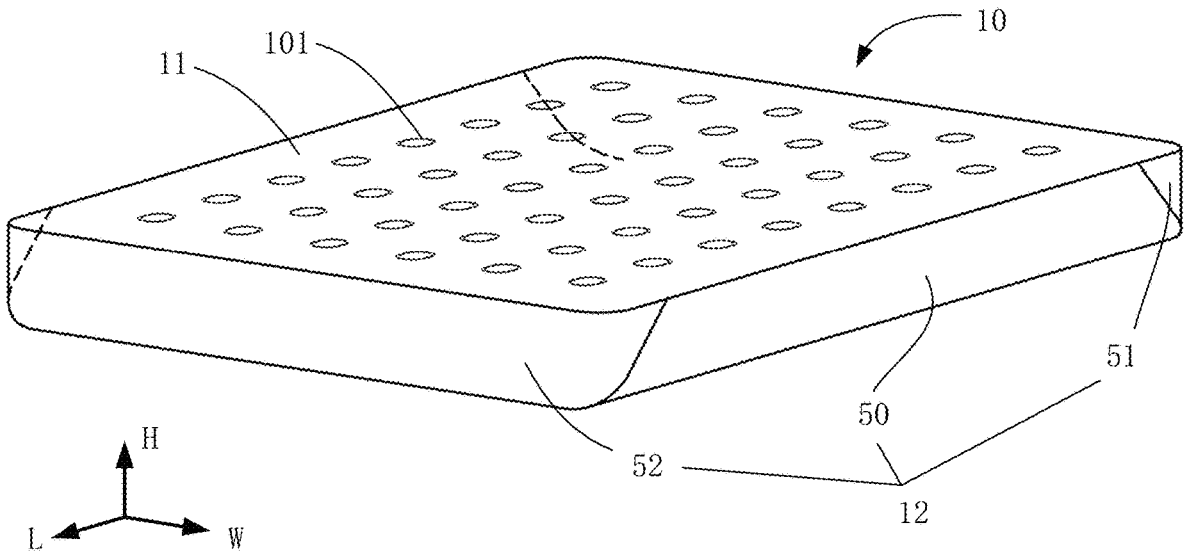
FIG. 12 schematically shows a fifth embodiment of an inflatable mattress, according to one or more embodiments shown and described herein.
Figure 13:
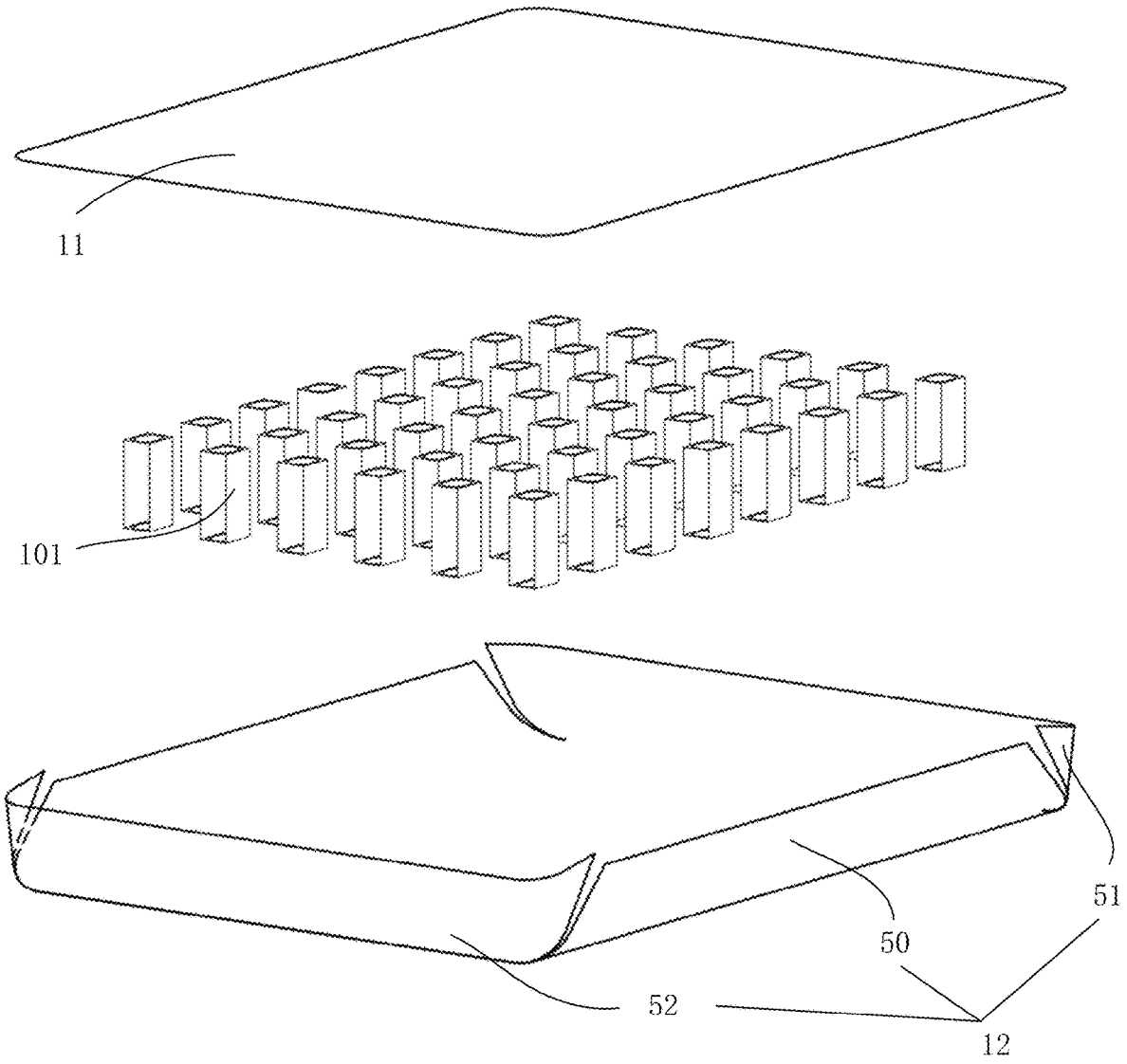
FIG. 13 is an exploded view of the inflatable mattress of FIG. 12, according to one or more embodiments shown and described herein.

Referring now to FIGS. 12 and 13, an inflatable mattress 10 of the fifth embodiment is substantially rectangular and includes a first sheet 11 and a second sheet 12. The first sheet 11 and the second sheet 12 are arranged opposite each other and connected together.

The fifth embodiment is similar to the previous embodiments, but it comprises to side portions 51, 21 made in one piece with the main portion 50 of the second sheet 12 and running in the width direction W of the mattress 10, with the first sheet 11 devoid of any chamfered edge.

Figure 14A:
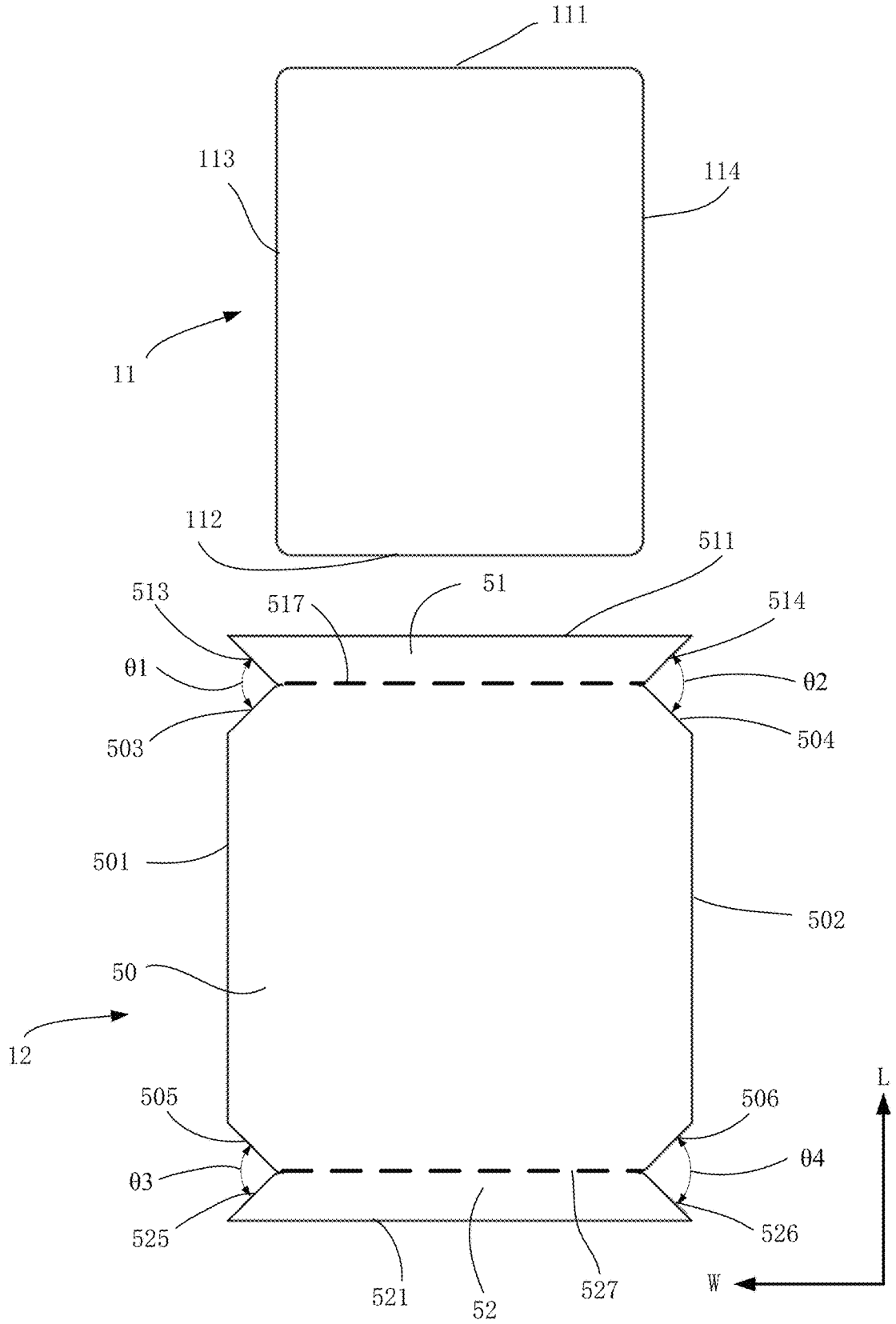
FIG. 14*a* is an expanded view of the inflatable mattress in FIG. 12, according to one or more embodiments shown and described herein.

As shown in FIG. 14*a*, the first sheet 11 is substantially rectangular, a width direction of the first sheet 11 runs substantially along the width direction W of the inflatable mattress 10, and a length direction of the first sheet 11 runs substantially along the length direction L of the inflatable mattress 10. The first sheet 11 includes a first edge 111 and a second edge 112 arranged opposite each other, and a third edge 113 and a fourth edge 114 arranged opposite each other. The first edge 111 of the first sheet 11 and the second edge 112 of the first sheet 11 extend substantially in the width direction L of the inflatable mattress 10, and the third edge 113 of the first sheet 11 and the fourth edge 114 of the first sheet 11 extend substantially in the length direction W of the inflatable mattress 10.

It should be noted that the first sheet 11 does not have a chamfered edge.

Further, as shown in FIG. 14*a*, the second sheet 12 includes a main portion 50, a first side portion 51 and a second side portion 52. The main portion 50 of the second sheet 12 is substantially rectangular, a width direction of the main portion 50 of the second sheet 12 runs substantially in the width direction W of the inflatable mattress 10, and a length direction of the main portion 50 of the second sheet 12 runs substantially in the length direction L of the inflatable mattress 10. The first side portion 51 of the second sheet 12 and the second side portion 52 of the second sheet 12 are connected to two sides of the main portion 50 of the second sheet in the length direction of the main portion 50 of the second sheet 12. In other words, the main portion 50 of the second sheet 12, the first side portion 51 of the second sheet 12, and the second side portion 52 of the second sheet 12 are made of the same piece of material. A first folding axis 517 is provided between the first side portion 51 of the second sheet 12 and the main portion 50 of the second sheet 12. A second folding axis 527 is provided between the second side portion 52 of the second sheet 12 and the main portion 50 of the second sheet 12.

The first folding axis 517 corresponds to the first edge of the main portion 50 of the second sheet 12 and to the first edge of the first side element.

The first folding axis 517 corresponds to the second edge of the main portion 50 of the second sheet 12 and to the first edge of the second side element.

The main portion 50 of the second sheet 12 has a first length edge 501 and a second length edge 502. The first length edge 501 of the main portion 50 of the second sheet 12 and the second length edge 502 of the main portion 50 of the second sheet 12 are opposite each other and are two length edges of the main portion 50 of the second sheet 12. In addition, the main portion 50 of the second sheet 12 further has a first chamfered edge 503, a second chamfered edge 504, a third chamfered edge 505, and a fourth chamfered edge 506. The first chamfered edge 503 of the main portion 50 of the second sheet 12 and the third chamfered edge 505 of the main portion 50 of the second sheet 12 are respectively connected to two ends of the first length edge 501 of the main portion 50 of the second sheet 12. The second chamfered edge 504 of the main portion 50 of the second sheet 12 and the fourth chamfered edge 506 of the main portion 50 of the second sheet 12 are respectively connected to two ends of the second length edge 502 of the main portion 50 of the second sheet 12.

The first side portion 51 of the second sheet 12 extends in the width direction W of the inflatable mattress 10 and has an outer edge 511 extending substantially in the width direction W of the inflatable mattress 10. The first side portion 51 of the second sheet 12 further has a first beveled edge 513 and a second beveled edge 514 located at two ends thereof. Two ends of the first beveled edge 513 of the first side portion 51 of the second sheet 12 are respectively connected to the outer edge 511 of the first side portion 51 of the second sheet 12 and the first chamfered edge 503 of the main portion 50 of the second sheet 12. The first beveled edge 513 of the first side portion 51 of the second sheet 12 is equal to the first chamfered edge 503 of the main portion 50 of the second sheet 12 in length, and may also be symmetrical with respect to the first folding axis 517 of the second sheet 12. A first angle θ1 is formed between the first beveled edge 513 of the first side portion 51 of the second sheet 12 and the first chamfered edge 503 of the main portion 50 of the second sheet 12. Optionally, the first angle θ1 may be less than or equal to 160°. Further, the first angle θ1 is a right angle.

Two ends of the second beveled edge 514 of the first side portion 51 of the second sheet 12 are respectively connected to the outer edge 511 of the first side portion 51 of the second sheet 12 and the second chamfered edge 504 of the main portion 50 of the second sheet 12. The second beveled edge 514 of the first side portion 50 of the second sheet 12 is equal to the second chamfered edge 504 of the main portion 50 of the second sheet 12 in length, and may also be symmetrical with respect to the first folding axis 517 of the second sheet 12. A second angle θ2 is formed between the second beveled edge 514 of the first side portion 51 of the second sheet 12 and the second chamfered edge 504 of the main portion 50 of the second sheet 12. Optionally, the second angle θ2 may be less than or equal to 160°. Further, the second angle θ2 is a right angle.

The second side portion 52 of the second sheet 12 and the first side portion 51 of the second sheet 12 have the same shape, and may also be in mirror symmetry. For example, the second side portion 52 of the second sheet 12 includes an outer edge 521, a first beveled edge 525, and a second beveled edge 526. Two ends of the first beveled edge 525 of the second side portion 52 of the second sheet 12 are respectively connected to the outer edge 521 of the second side portion 52 of the second sheet 12 and the third chamfered edge 505 of the main portion 50 of the second sheet 12. The first beveled edge 525 of the second side portion 52 of the second sheet 12 is equal to the third chamfered edge 505 of the main portion 50 of the second sheet 12 in length, and may also be symmetrical with respect to the second folding axis 527 of the second sheet 12. A third angle θ3 is formed between the first beveled edge 525 of the second side portion 52 of the second sheet 12 and the third chamfered edge 505 of the main portion 50 of the second sheet 12. Optionally, the third angle θ3 may be less than or equal to 160°. Further, the third angle θ3 is a right angle.

Two ends of the second beveled edge 526 of the second side portion 52 of the second sheet 12 are respectively connected to the outer edge 521 of the second side portion 52 of the second sheet 12 and the fourth chamfered edge 506 of the main portion 50 of the second sheet 12. The second beveled edge 526 of the second side portion 52 of the second sheet 12 is equal to the fourth chamfered edge 506 of the main portion 50 of the second sheet 12 in length, and may also be symmetrical with respect to the second folding axis 527 of the second sheet 12. A fourth angle θ4 is formed between the second beveled edge 526 of the second side portion 52 of the second sheet 12 and the fourth chamfered edge 506 of the main portion 50 of the second sheet 12. Optionally, the fourth angle θ4 may be less than or equal to 160°. Further, the fourth angle θ4 is a right angle.

Therefore, the inflatable mattress 10 according to this embodiment may comprise: the first sheet 11 fully defined by its main portion and provided with a first edge 111, a second edge 112, a third edge 113 and a fourth edge 114; the second sheet 12 comprising a main portion 50 made in one piece with a first side portion 51, defining the first side element 14, and a second side portion 52, defining the second side element 15.

The main portion 50 of the second sheet 12 may comprise: a first edge, defined by the folding axis 517; a second edge, defined by the folding axis 527; a third edge, defined by the first length edge 501; a fourth edge, defined by the second length edge 502.

The first side portion 51 may comprise: a first edge, defined by the outer edge 511; a second edge, defined by the folding axis 517; a first end portion comprising a first beveled edge 513; a second end portion comprising a second beveled edge 514.

The second side portion 52 may comprise: a first edge, defined by the outer edge 521; a second edge, defined by the folding axis 527; a first end portion comprising a first beveled edge 525; a second end portion comprising a second beveled edge 526.

Figure 14B:
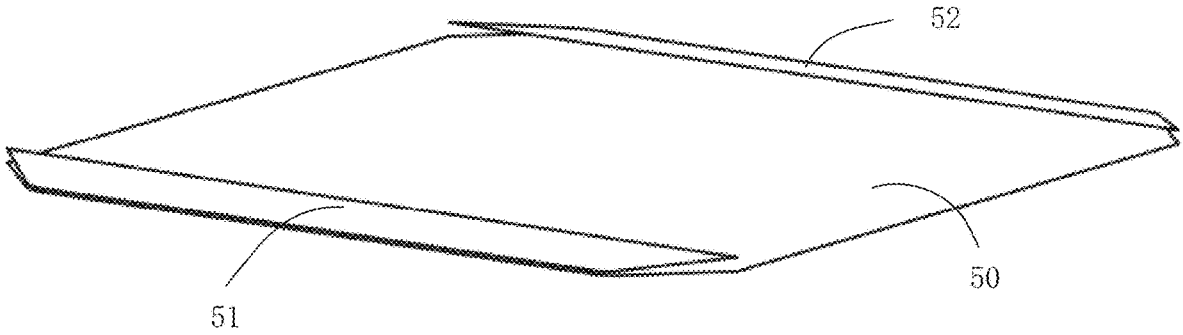
FIGS. 14*b* and 14*c* schematically show a manufacturing process of the inflatable mattress shown in FIG. 12, according to one or more embodiments shown and described herein.
Figure 14C:
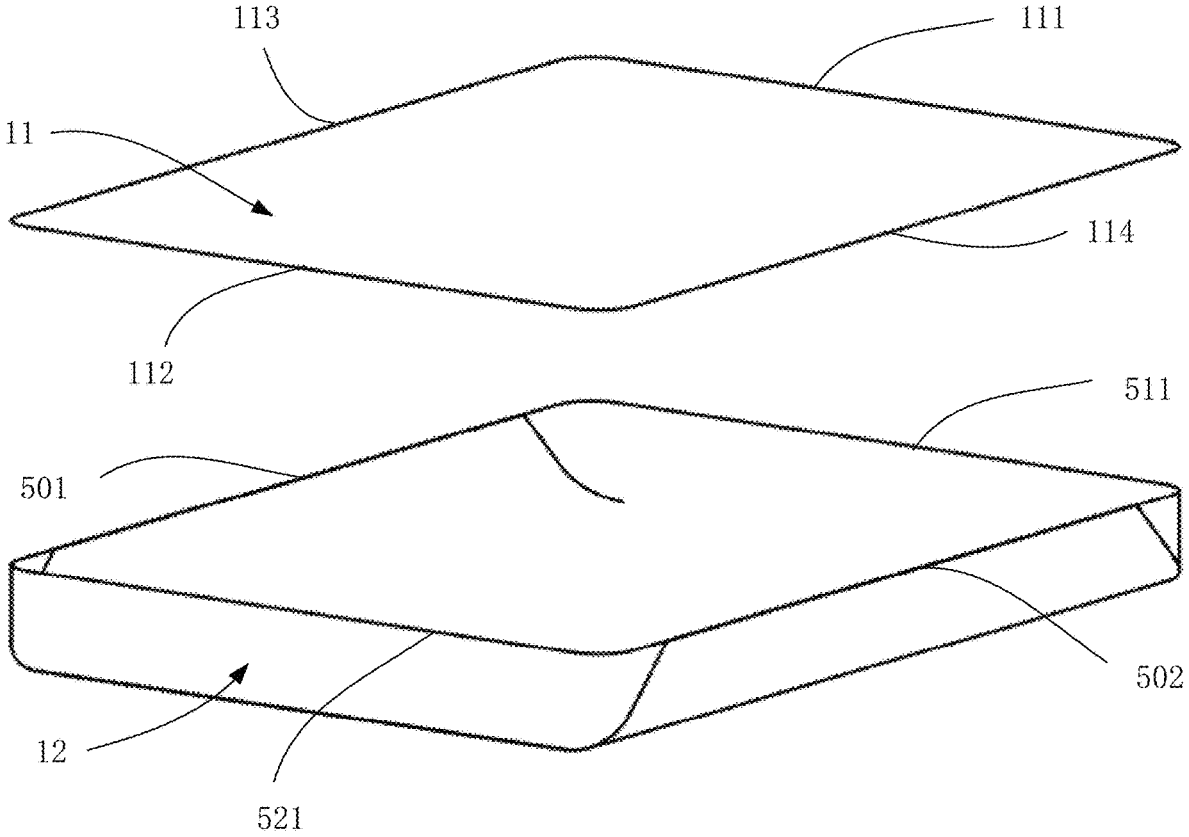

During the manufacture of the inflatable mattress 10, as shown in FIG. 14*b*, the first side portion 51 of the second sheet 12 is folded along the first folding axis 517 of the second sheet 12 to be attached to the main portion 50 of the second sheet 12. The second side portion 52 of the second sheet 12 is folded along the second folding axis 527 of the second sheet 12 to be attached to the main portion 50 of the second sheet 12. The first chamfered edge 503 of the main portion 50 of the second sheet 12 is aligned with the first beveled edge 513 of the first side portion 51 of the second sheet 12, the second chamfered edge 504 of the main portion 50 of the second sheet 12 is aligned with the second beveled edge 514 of the first side portion 51 of the second sheet 12, the third chamfered edge 505 of the main portion 50 of the second sheet 12 is aligned with the first beveled edge 525 of the second side portion 52 of the second sheet 12, and the fourth chamfered edge 506 of the main portion 50 of the second sheet 12 is aligned with the second beveled edge 526 of the second side portion 52 of the second sheet 12. Thus, the second sheet 12 is substantially in the same plane. Next, with a welding apparatus, the first chamfered edge 503 of the main portion 50 of the second sheet 12 is connected to the first beveled edge 513 of the first side portion 51 of the second sheet 12. The second chamfered edge 504 of the main portion 50 of the second sheet 12 is connected to the second beveled edge 514 of the first side portion 51 of the second sheet 12. The third chamfered edge 505 of the main portion 50 of the second sheet 12 is connected to the first beveled edge 525 of the second side portion 52 of the second sheet 12. The fourth chamfered edge 506 of the main portion 50 of the second sheet 12 is connected to the second beveled edge 526 of the second side portion 52 of the second sheet 12. Finally, the first sheet 11 and the second sheet 12 are connected together (as shown in FIG. 14*c*). For example, the third edge 113 of the first sheet 11 is connected to the first length edge 501 of the main portion 50 of the second sheet 12. The fourth edge 114 of the first sheet 11 is connected to the second length edge 502 of the main portion 50 of the second sheet 12. The first edge 111 of the first sheet 11 is connected to the outer edge 511 of the first side portion 51 of the second sheet 12. The second edge 112 of the first sheet 11 is connected to the outer edge 521 of the second side portion 52 of the second sheet 12. In the mattress structure of this embodiment, the connection of the relevant edges of the second sheet in a substantially planar state by means of the welding apparatus is achieved, and the step of manually fixing the sheets to a welding mold is omitted, thereby providing a basis for improving the level of automation of manufacturing the inflatable mattress and reducing the manufacturing cost.

The foregoing descriptions are merely embodiments of the present disclosure and are not intended to limit the present disclosure. A person skilled in the art may make various changes and variations to the present disclosure. Any modifications, equivalent replacements, and improvements made without departing from the spirit and principle of the present disclosure shall fall within the scope of the claims of the present disclosure.

Although the present disclosure has been illustrated and described with reference to some preferred implementations of the present disclosure, those of ordinary skill in the art should understand that the above contents are further detailed descriptions for the present disclosure with reference to specific implementations, and it cannot be assumed that the specific implementations of the present disclosure are limited to these descriptions. Those skilled in the art can make various changes in form and details, including several simple deduction or substitutions, without departing from the spirit and scope of the present disclosure.

The foregoing descriptions are only embodiments of the present disclosure and are not intended to limit the present disclosure. For those skilled in the art, various changes and variations can be made to the present disclosure. Any modifications, equivalent replacements, and improvements made without departing from the spirit and principle of the present disclosure shall fall within the scope of the claims of the present disclosure.

Furthermore, it should be apparent that the present disclosure is not limited to the details of the above-mentioned exemplary embodiments, and the present disclosure can be implemented in other specific forms without departing from the spirit or basic features of the present disclosure. Therefore, no matter from which point of view, the embodiments should all be regarded as exemplary and non-limiting. The scope of the present disclosure is defined by the appended claims rather than the above-mentioned description, and therefore it is intended that all changes which fall within the meaning and range of equivalents of the claims are embraced in the present disclosure. Any reference signs in the claims should not be construed as limiting the claims involved. In addition, it is apparent that the word "comprise/include" does not exclude other elements or steps, and the singular does not exclude the plural. The terms first, second, etc. are used for designations and do not represent any particular order.

It should be understood that the embodiments as shown in the drawings only show the optional shapes, sizes and arrangements of optional components of the air valve and inflatable products according to the present disclosure, which are merely illustrative but not restrictive, and other shapes, sizes and arrangements may be employed without departing from the idea and scope of the present disclosure.

The technical contents and technical features of the present disclosure are disclosed above, but it can be understood that those skilled in the art would have made various variations and improvements to the concepts disclosed above under the creative idea of the present disclosure, and all the variations and improvements fall into the scope of protection of the present disclosure. The descriptions of the above embodiments are illustrative but not restrictive, and the scope of protection of the present disclosure is determined by the claims.

The invention claimed is:

1. An inflatable mattress, comprising:

a first sheet having a main portion comprising:

a first edge and a second edge arranged opposite each other; and a third edge and a fourth edge arranged opposite each other, and a second sheet, arranged opposite the first sheet and having a main portion comprising:

a first edge and a second edge arranged opposite each other; and a third edge and a fourth edge arranged opposite each other;

wherein at least one of the main portions of the first sheet or of the second sheet comprises a first chamfered edge connecting the first edge and the third edge; and at least one side element at least partly defining an inflatable chamber together with the main portions of the first sheet and of the second sheet, the at least one side element comprising:

a first edge connected to the first edge of the main portion of the first sheet;

a second edge arranged opposite the first edge of the at least one side element and connected to the first edge of the main portion of the second sheet;

a first end portion comprising a first beveled edge connected to the first chamfered edge of the main portion of first sheet or of the second sheet; and a second end portion.

2. The inflatable mattress according to claim 1, wherein the main portion of the first sheet or of the second sheet further comprises a second chamfered edge connecting the first edge and the fourth edge of the main portion of the first sheet; and the second end portion of the side element comprises a second beveled edge connected to the second chamfered edge of the main portion of the first sheet.

3. The inflatable mattress according to claim 2, wherein said side element is a first side element and the inflatable mattress comprises a second side element, the second side element comprising:

a first edge connected to the second edge of the main portion of the first sheet;

a second edge arranged opposite the first edge of the second side element and connected to the second edge of the main portion of the second sheet;

a first end portion comprising a first beveled edge; and a second end portion comprising a second beveled edge; and the main portion of the first sheet further comprises:

a third chamfered edge connecting the second edge and the third edge of the main portion of the first sheet; and a fourth chamfered edge connecting the second edge and the fourth edge of the main portion of the first sheet;

wherein the first beveled edge of the first end portion of the second side element is connected to the third chamfered edge of main portion of the first sheet, and the second beveled edge of the second end portion of the second side element is connected to the fourth chamfered edge of the main portion of the second sheet.

4. The inflatable mattress according to claim 3, wherein the main portion of the second sheet further comprises:

a first chamfered edge connecting the first edge and the third edge of the main portion of the second sheet; and a second chamfered edge connecting the first edge and the fourth edge of the main portion of the second sheet;

wherein the first end portion of the first side element comprises a third beveled edge connected to the first chamfered edge of the main portion of the second sheet and the second end portion of the first side element comprises a fourth beveled edge connected to the second chamfered edge of the main portion of the second sheet.

5. The inflatable mattress according to claim 4, wherein the main portion of the second sheet further comprises:

a third chamfered edge connecting the second edge and the third edge of the main portion of the second sheet; and a fourth chamfered edge connecting the second edge and the fourth edge of the main portion of the second sheet;

wherein the first end portion of the second side element comprises a third beveled edge connected to the third chamfered edge of the main portion of the second sheet and the second end portion of the second side element comprises a fourth beveled edge connected to the fourth chamfered edge of the main portion of the second sheet.

6. The inflatable mattress according to claim 1, wherein said at least one side element is made of the same piece of material of the first sheet or of the second sheet.

7. The inflatable mattress according to claim 1, wherein the main portion of the second sheet comprises:

a first chamfered edge connecting the first edge and the third edge of the main portion of the second sheet;

wherein the first end portion of the at least one side element comprises a third beveled edge connected to the first chamfered edge of the main portion of the second sheet; and wherein the at least one side element comprises:

a first side sub-sheet comprising:

the first edge of the at least one element;

the first beveled edge of the at least one side element; and a joining edge; and a second side sub-sheet comprising:

the second edge of the at least one side element;

the third beveled edge of the at least one side element; and a joining edge connected to the joining edge of the first side sub-sheet.

8. The inflatable mattress according to claim 7, wherein:

the main portion of the first sheet further comprises a second chamfered edge connecting the first edge and the fourth edge of the main portion of the second sheet;

the second end portion of the at least one side element comprises a second beveled edge connected to the second chamfered edge of the main portion of the first sheet; and the first side sub-sheet comprises the second beveled edge of the at least one side element.

9. The inflatable mattress according to claim 7, wherein:

the main portion of the second sheet further comprises a second chamfered edge connecting the first edge and the fourth edge of the main portion of the second sheet;

the second end portion of the at least one side element comprises a fourth beveled edge connected to the second chamfered edge of the main portion of the second sheet; and the second side sub-sheet comprises the fourth beveled edge of the at least one side element.

10. The inflatable mattress according to claim 7, wherein the first side sub-sheet and the main portion of the first sheet are made of the same piece of material.

11. The inflatable mattress according to claim 7, wherein the second side sub-sheet and the main portion of the second sheet are made of the same piece of material.

12. The inflatable mattress according to claim 1, wherein the third edge of the main portion of the first sheet is directly connected to the third edge of the main portion of the second sheet, and the fourth edge of the main portion of the first sheet is directly connected to the fourth edge of the main portion of the second sheet.

13. An inflatable mattress comprising:

at least one sheet having a main portion comprising a chamfered edge;

at least one side sheet at least partially defining an inflatable chamber, the at least one side sheet comprising at least one end portion including a beveled edge;

wherein the at least one sheet is stacked on the at least one side sheet such that the chamfered edge of the main portion of the at least one sheet is connected to the beveled edge of the at least one end portion of the at least one side sheet.

14. The inflatable mattress of claim 13, wherein the at least one side sheet further comprises at least one side sub-sheet, the at least one side sub-sheet comprising:

at least one edge of the at least one side sheet; and the beveled edge of the at least one side sheet.

15. The inflatable mattress of claim 14, wherein the at least one side sub-sheet further comprises at least one joining edge, and at least one end of the joining edge is connected to the beveled edge of the at least one side sheet.

16. The inflatable mattress of claim 13, further comprising a plurality of tensioning members disposed within the inflatable chamber.

17. The inflatable mattress of claim 16, wherein each of the plurality of tensioning members includes a plurality of layers of sheet materials.

18. The inflatable mattress of claim 13, wherein an angle is formed between the chamfered edge and the beveled edge, the angle being a right angle.

19. The inflatable mattress of claim 13, wherein at least one folding axis is defined between the at least one side sheet and the main portion of the at least one sheet.

20. A method of manufacturing an inflatable mattress, the method comprising:

providing at least one sheet having a main portion comprising a chamfered edge;

providing at least one side sheet comprising at least one end portion including a beveled edge;

stacking the at least one sheet on the at least one side sheet, such that the at least one sheet and the at least one side sheet form a planar shape and the chamfered edge of the at least one sheet is aligned with the beveled edge of the at least one side sheet;

connecting, using an automatic device, the chamfered edge of the at least one sheet and the beveled edge of the at least one side sheet.

* * * * *